US011007786B2

(12) United States Patent
Tokisawa et al.

(10) Patent No.: US 11,007,786 B2
(45) Date of Patent: May 18, 2021

(54) INKJET PRINTING APPARATUS AND CONTROL METHOD OF INKJET PRINTING APPARATUS

(71) Applicant: CANON KABUSHIKI KAISHA, Tokyo (JP)

(72) Inventors: Toshiaki Tokisawa, Kawasaki (JP); Tsuyoshi Saeki, Kawasaki (JP); Takashi Abe, Kawasaki (JP); Yumi Mukoyama, Kawasaki (JP); Ryoma Arai, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 36 days.

(21) Appl. No.: 16/583,750

(22) Filed: Sep. 26, 2019

(65) Prior Publication Data

US 2020/0108617 A1 Apr. 9, 2020

(30) Foreign Application Priority Data

Oct. 5, 2018 (JP) ..... JP2018-189622

(51) Int. Cl.

| | |
|---|---|
| ***B41J 2/17*** | (2006.01) |
| ***B41J 2/165*** | (2006.01) |
| ***B41J 2/175*** | (2006.01) |

(52) U.S. Cl.

CPC ..... *B41J 2/1721* (2013.01); *B41J 2/16505* (2013.01); *B41J 2/17596* (2013.01)

(58) Field of Classification Search

CPC .. B41J 2/1721; B41J 2/16505; B41J 2/17596; B41J 2/18; B41J 2002/17579; B41J 2/17566; B41J 2/175; B41J 2/16588; B41J 2/16532; B41J 2/16517; B41J 2/16508; B41J 2/17503; B41J 29/393

See application file for complete search history.

(56) References Cited

U.S. PATENT DOCUMENTS

2006/0132554 A1* 6/2006 Ota ..... B41J 2/17556 347/85

2010/0079562 A1* 4/2010 Katada ..... B41J 2/175 347/85

FOREIGN PATENT DOCUMENTS

JP 2014024189 A 2/2014

* cited by examiner

*Primary Examiner* — Henok D Legesse

(74) *Attorney, Agent, or Firm* — Carter, DeLuca & Farrell LLP

(57) ABSTRACT

An inkjet printing apparatus performs: a first operation for pulling out ink in a flow path of the ejection opening up to the collection flow path into the first tank by operating the tank vacuum pump with the supply valve being closed and a second operation for pulling out ink in a flow path of the first tank up to the ejection opening by operating the cap vacuum pump with the collection valve being closed and the atmosphere release valve being opened.

19 Claims, 24 Drawing Sheets

INKJET PRINTING APPARATUS AND CONTROL METHOD OF INKJET PRINTING APPARATUS

BACKGROUND OF THE INVENTION

Field of the Invention

The present invention relates to an inkjet printing apparatus and a control method of the inkjet printing apparatus.

Description of the Related Art

In a case of transporting an inkjet printing apparatus, there is a case of removing ink inside an ink flow path including a print head. Japanese Patent Laid-Open No. 2014-024189 (hereinafter referred to as Document 1) discloses an inkjet printing apparatus including a print head and an ink flow path for supplying ink from an ink tank to the print head via a sub-tank. Further, there is disclosed a suctioning pump that suctions ink from a nozzle array, which ejects ink, in a state where the ink tank is not attached, so as to discharge ink of the ink flow path.

However, in a case where the flow path is complicated, there is a possibility that the ink in the flow path cannot be properly removed only by the method of suctioning the ink from the nozzle array as described in Document 1.

SUMMARY OF THE INVENTION

An inkjet printing apparatus according to an embodiment of the present invention includes: a print head configured to have an ejection opening for ejecting ink; a first tank configured to contain ink to be supplied to the print head; a supply flow path configured to connect the first tank to the print head and supply ink to the print head; a collection flow path configured to connect the print head to the first tank and collect ink from the print head; a supply valve configured to be capable of opening and closing the supply flow path; a collection valve configured to be capable of opening and closing the collection flow path; a tank vacuum pump configured to reduce pressure inside the first tank; an atmosphere release valve configured to be capable of switching whether or not an inside of the first tank communicates with an atmosphere; a cap configured to cover the ejection opening; a cap vacuum pump configured to reduce pressure inside the cap with the ejection opening being covered by the cap; and a control unit configured to perform a first operation for pulling out ink in a flow path of the ejection opening up to the collection flow path into the first tank by operating the tank vacuum pump with the supply valve being closed and a second operation for pulling out ink in a flow path of the first tank up to the ejection opening by operating the cap vacuum pump with the collection valve being closed and the atmosphere release valve being opened.

Further features of the present invention will become apparent from the following description of exemplary embodiments with reference to the attached drawings.

DESCRIPTION OF THE EMBODIMENTS

Figure 1:
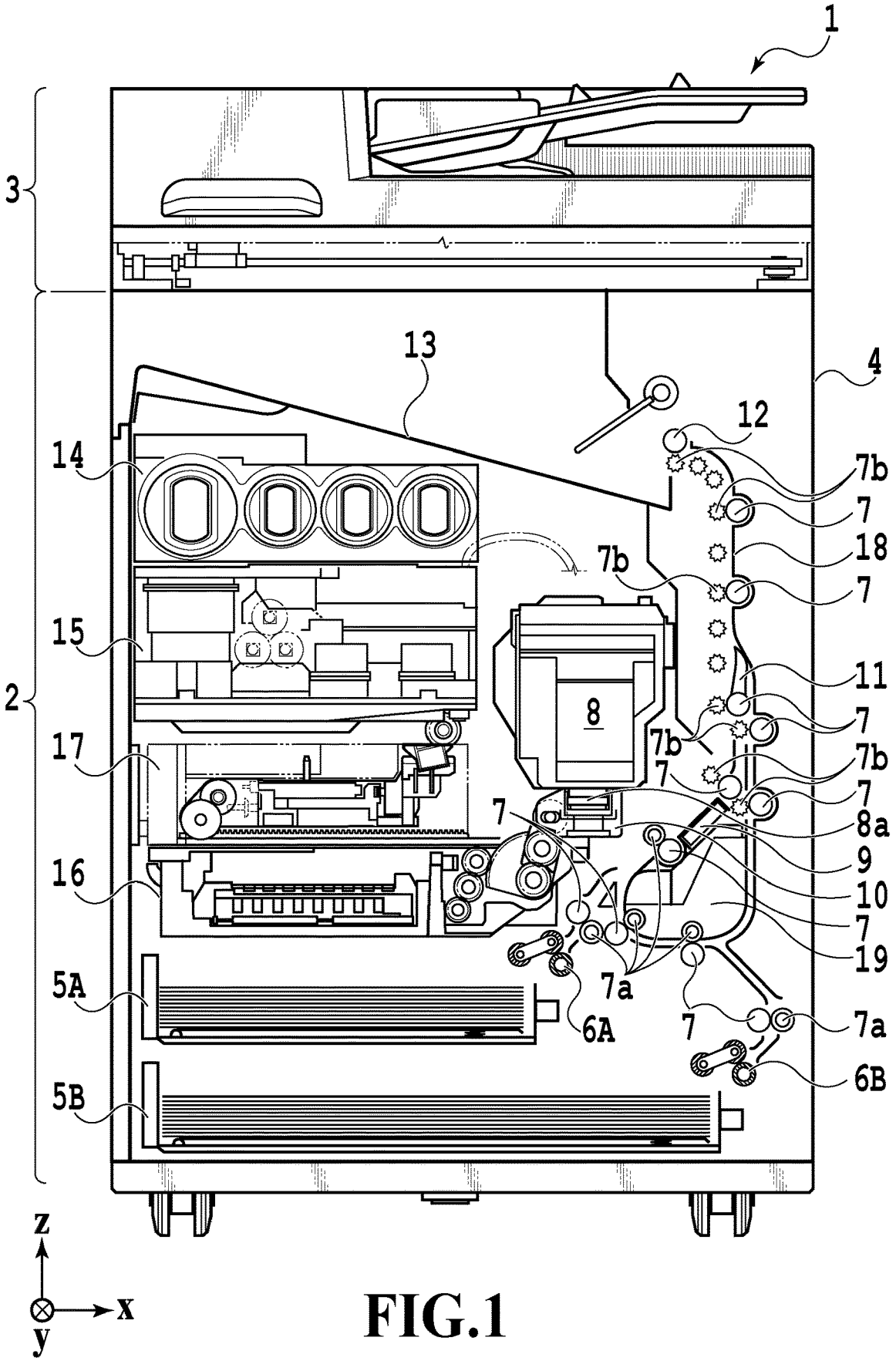
FIG. 1 is a diagram showing a printing apparatus in a standby state.

Embodiments of the present invention will be described below with reference to the drawings. It should be noted that the following embodiments do not limit the present invention and that not all of the combinations of the characteristics described in the present embodiments are essential for solving the problem to be solved by the present invention. Incidentally, the same reference numeral refers to the same component in the following descriptions. Furthermore, relative positions, shapes, and the like of the constituent elements described in the embodiments are exemplary only and are not intended to limit the scope of the invention.

First Embodiment

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. That is, the print head 8 is configured to be capable of ejecting ink of a plurality of colors. In a case where the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8.

Figure 2:
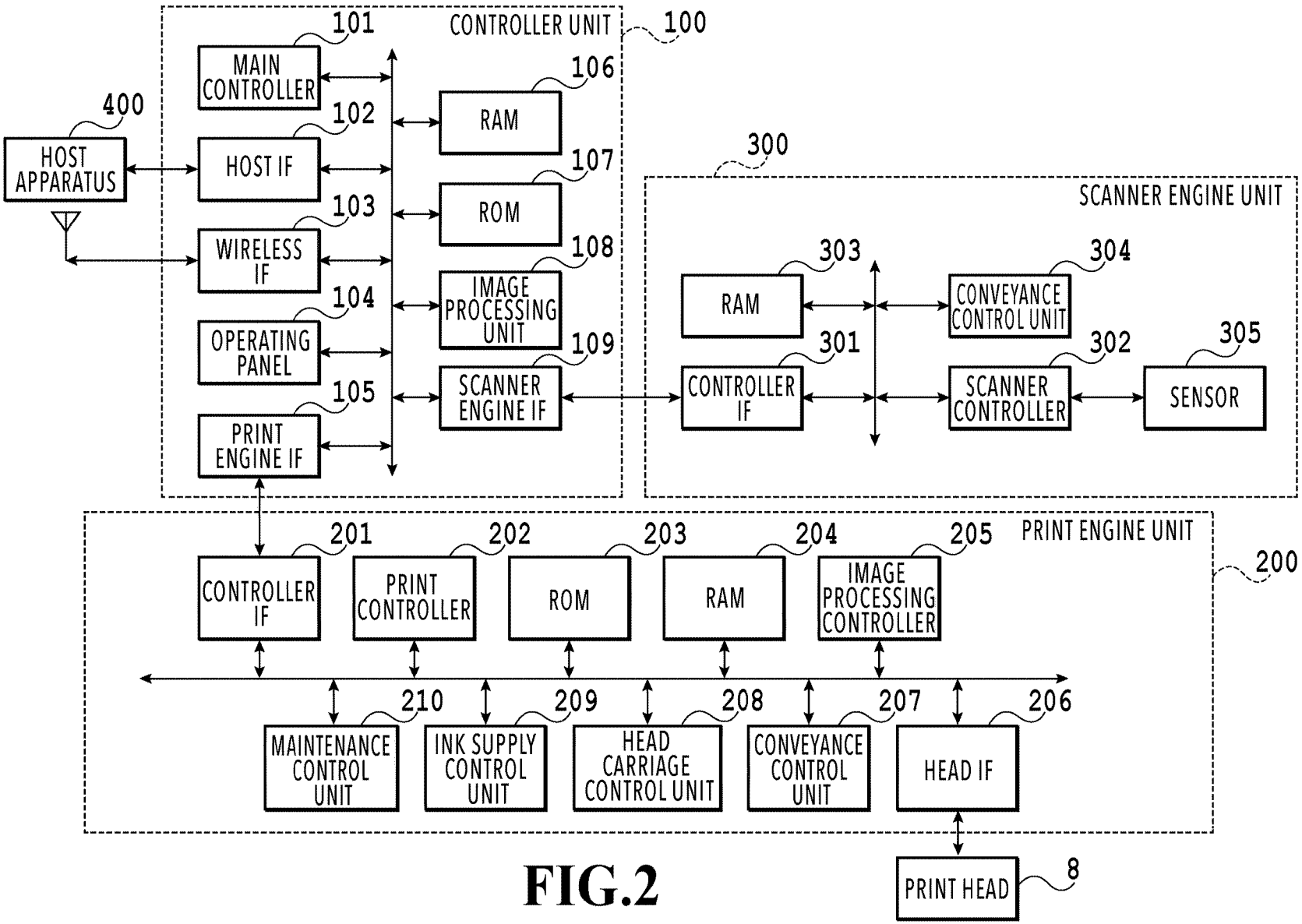
FIG. 2 is a control configuration diagram of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, in a case where a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, if a scan command is input from the host apparatus 400, the main controller 101 transmits the command to the scanner unit 3 via a scanner engine I/F 109.

An operating panel 104 is a mechanism to allow a user to do input and output for the printing apparatus 1. The operating panel 104 is configured, for example, with a touch-sensitive panel display including a touch-sensitive panel for receiving an operation from a user and a display for displaying information. The operating panel 104 may further include an operation button. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. Once various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 at the time of performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
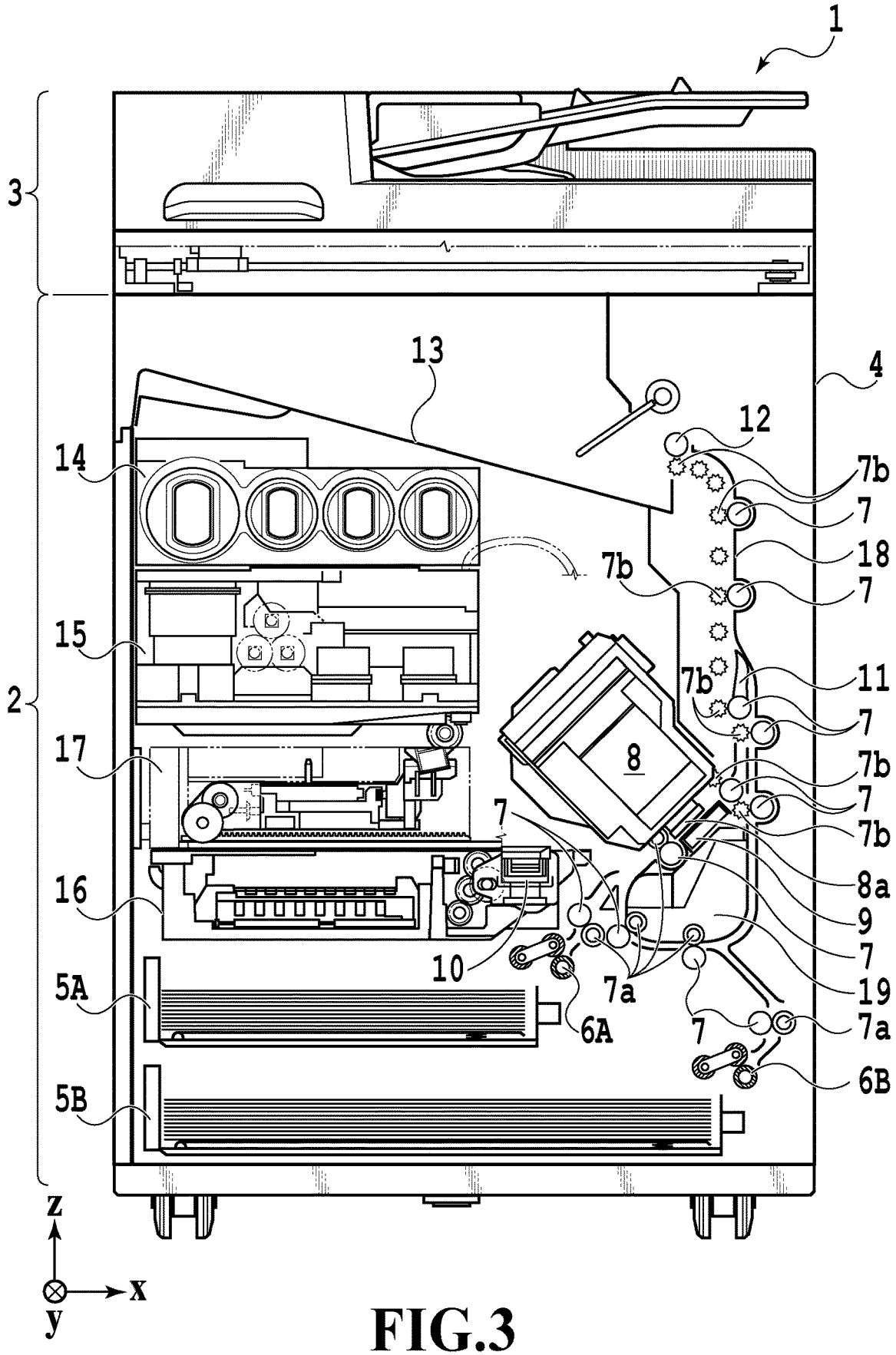
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined at about 45° with respect to the horizontal plane. The ejection opening surface 8*a* of the print head 8 in a printing position is also inclined at about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 by 45° while adjusting the vertical height of the print head 8 such that the ejection opening surface 8*a* faces the platen 9. After the completion of print operation, the print controller 202 reverses the above procedure to move the print head 8 from the printing position to the standby position.

Figure 4:
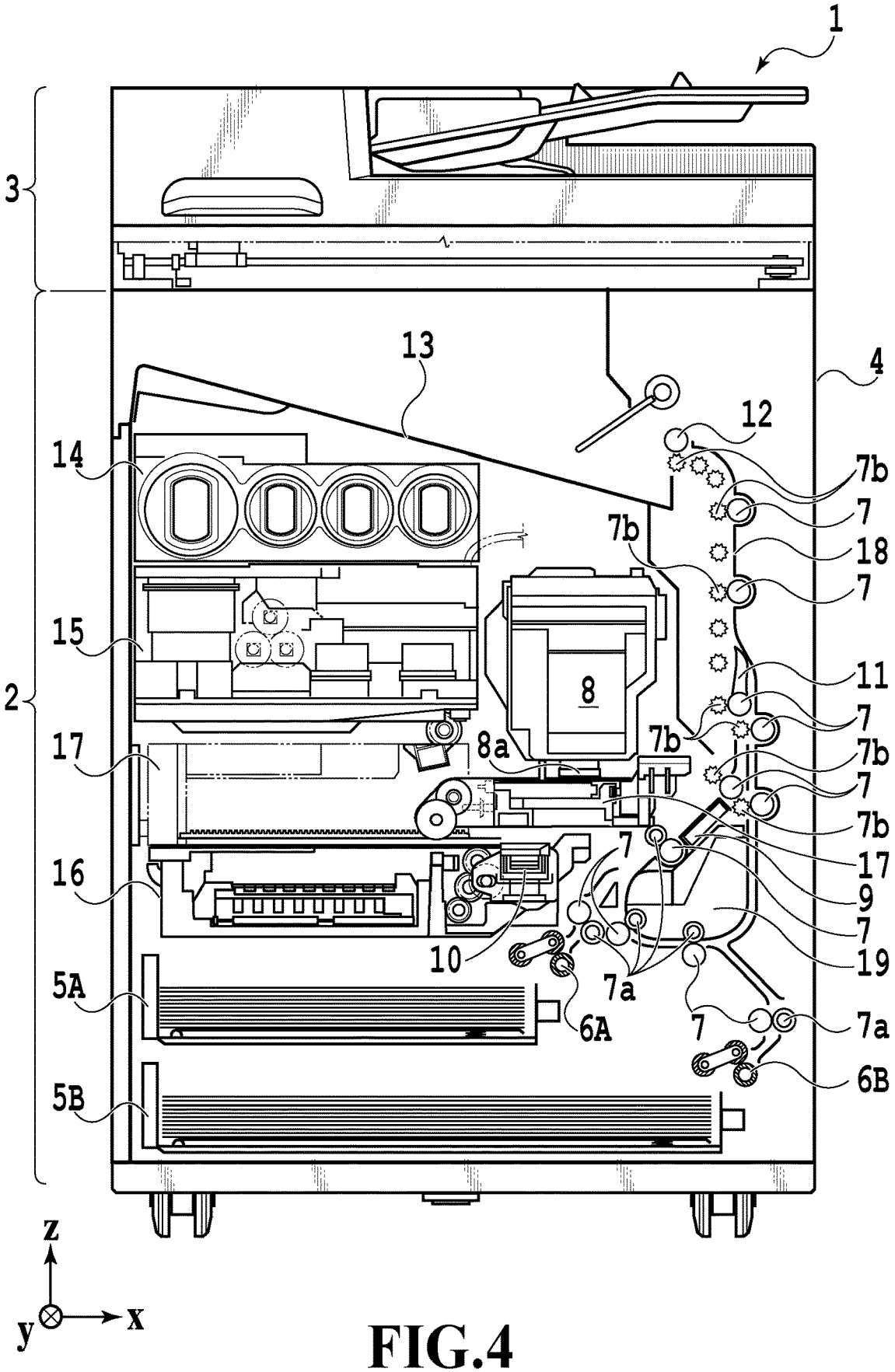
FIG. 4 is a diagram showing the printing apparatus in a maintenance state.

FIG. 4 is a diagram showing the printing apparatus 1 in a maintenance state. In the case of moving the print head 8 from the standby position shown in FIG. 1 to a maintenance position shown in FIG. 4, the print controller 202 moves the print head 8 vertically upward and moves the cap unit 10 vertically downward. The print controller 202 then moves the wiping unit 17 from the evacuation position to the right in FIG. 4. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 4, the print controller 202 moves the print head 8 vertically upward while turning it by 45°. The print controller 202 then moves the wiping unit 17 from the evacuation position to the right. Following that, the print controller 202 moves the print head 8 vertically downward to the maintenance position where maintenance operation can be performed by the maintenance unit 16.

(Ink Supply Unit (Circulation System))

Figure 5:
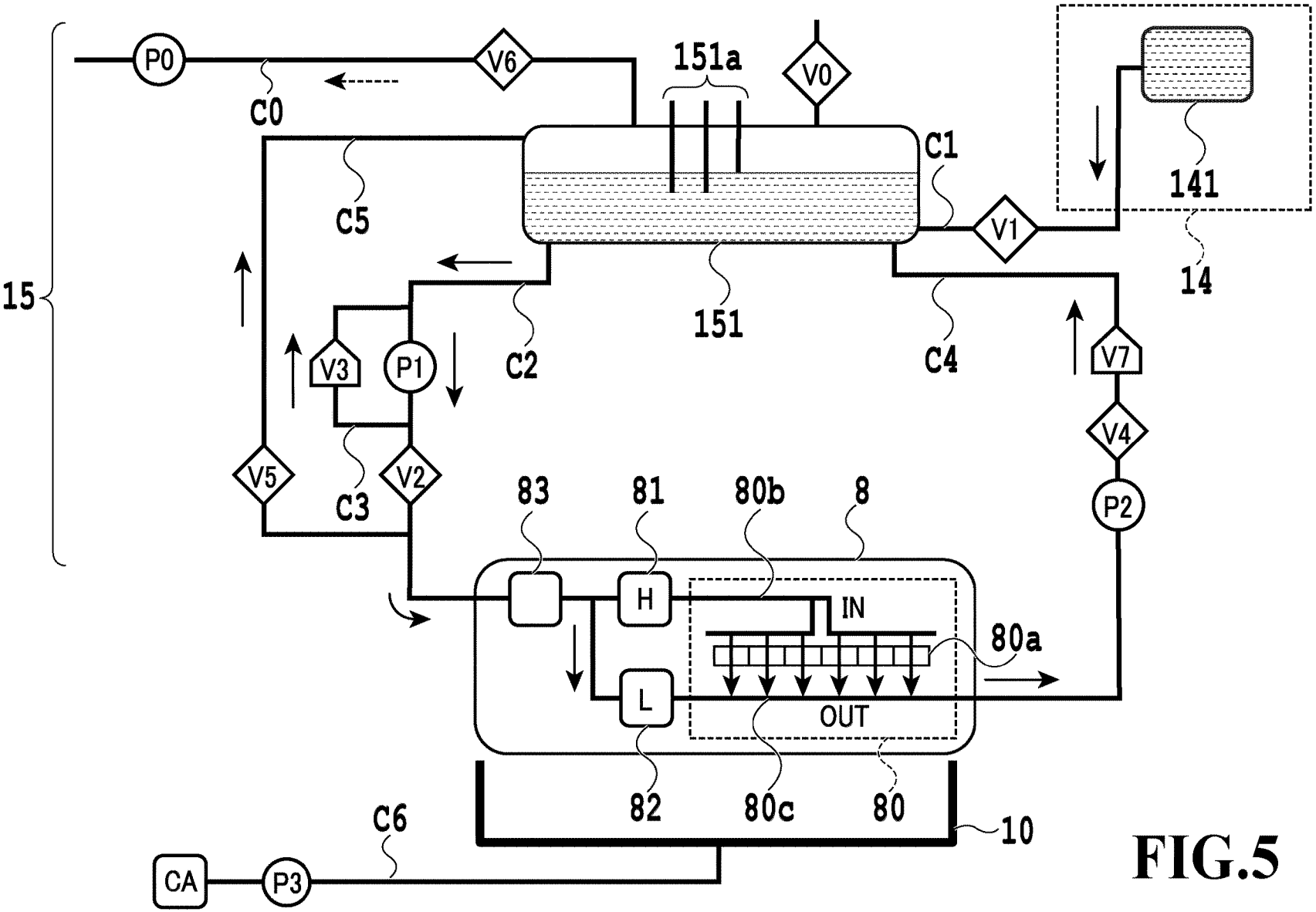
FIG. 5 is a diagram for explaining a flow path configuration of an ink circulation system.

FIG. 5 is a diagram including the ink supply unit 15 adopted in the printing apparatus 1 of the present embodiment. With reference of FIG. 5, a flow path configuration of an ink circulation system of the present embodiment will be described. The ink supply unit 15 supplies ink from the ink tank unit 14 to the print head 8 (head unit). In the diagram, a configuration of one color ink is shown, but such a configuration is practically prepared for each color ink. The ink supply unit 15 is basically controlled by the ink supply control unit 209 shown in FIG. 2. Each configuration of the ink supply unit 15 will be described below.

Ink is circulated mainly between a sub-tank 151 and the print head 8. In the print head 8, ink ejection operation is performed based on image data and ink that has not been ejected is collected and flows back to the sub-tank 151.

The sub-tank 151 in which a certain amount of ink is contained is connected to a supply flow path C2 for supplying ink to the print head 8 and to a collection flow path C4 for collecting ink from the print head 8. In other words, a circulation flow path (circulation path) for circulating ink is composed of the sub-tank 151, the supply flow path C2, the print head 8, and the collection flow path C4. Further, the sub-tank 151 is connected to a flow path C0 in which air flows. In the flow path C0 connected to the sub-tank 151, a sub-tank vacuum valve V6 is provided.

In the sub-tank 151, a liquid level detection unit 151*a* composed of a plurality of electrode pins is provided. The ink supply control unit 209 detects presence/absence of a conducting current between those pins so as to grasp a height of an ink liquid level, that is, an amount of remaining ink inside the sub-tank 151. A vacuum pump P0 (also referred to as a tank vacuum pump) is a negative pressure generating source for reducing pressure (or vacuuming) inside the sub-tank 151. An atmosphere release valve V0 is a valve for switching between whether or not to make the inside of the sub-tank 151 communicate with atmosphere.

A main tank 141 is a tank that contains ink which is to be supplied to the sub-tank 151. The main tank 141 is made of a flexible member, and the volume change of the flexible member allows filling the sub-tank 151 with ink. The main tank 141 has a configuration removable from the printing apparatus body. In the midstream of a tank connection flow path C1 connecting the sub-tank 151 and the main tank 141, a tank supply valve V1 for switching connection between the sub-tank 151 and the main tank 141 is provided.

Under the above configuration, once the liquid level detection unit 151*a* detects that ink inside the sub-tank 151 is less than the certain amount, the ink supply control unit 209 closes the atmosphere release valve V0, a supply valve V2, a collection valve V4, and a head replacement valve V5 and opens the tank supply valve V1. In this state, the ink supply control unit 209 causes the vacuum pump P0 to operate. Then, the inside of the sub-tank 151 is to have a negative pressure and ink is supplied from the main tank 141 to the sub-tank 151. Once the liquid level detection unit

151*a* detects that the amount of ink inside the sub-tank 151 is more than the certain amount, the ink supply control unit 209 closes the tank supply valve V1 and stops the vacuum pump P0.

The supply flow path C2 is a flow path for supplying ink from the sub-tank 151 to the print head 8, and a supply pump P1 and the supply valve V2 are arranged in the midstream of the supply flow path C2. During print operation, driving the supply pump P1 in the state of the supply valve V2 being open allows ink circulation in the circulation path while supplying ink to the print head 8. The amount of ink to be ejected per unit time by the print head 8 varies according to image data. A flow rate of the supply pump P1 is determined so as to be adaptable even in a case where the print head 8 performs ejection operation in which ink consumption amount per unit time becomes maximum.

A relief flow path C3 is a flow path which is located in the upstream of the supply valve V2 and which connects the upstream and downstream of the supply pump P1. In the midstream of the relief flow path C3, a relief valve V3 which is a differential pressure valve is provided. The relief valve V3 is not opened or closed by a drive mechanism. Instead, the relief valve V3 is urged by a spring and is configured to open in a case where the pressure reaches a predetermined level. For example, in a case where an amount of ink supply from the supply pump P1 per unit time is larger than the total value of an ejection amount of the print head 8 per unit time and a flow rate (ink drawing amount) in a collection pump P2 per unit time, the relief valve V3 is opened according to a pressure applied to its own. As a result, a cyclic flow path composed of a portion of the supply flow path C2 and the relief flow path C3 is formed. By providing the configuration of the above relief flow path C3, the amount of ink supply to the print head 8 is adjusted according to the ink consumption amount by the print head 8 so as to stabilize a pressure inside the circulation path irrespective of image data.

The collection flow path C4 is a flow path for collecting ink from the print head 8, back to the sub-tank 151. Further, the collection pump P2 and the collection valve V4 are arranged in the midstream of the collection flow path C4. At the time of ink circulation within the circulation path, the collection pump P2 sucks ink from the print head 8 by serving as a negative pressure generating source. By driving the collection pump P2, an appropriate differential pressure is generated between an IN flow path 80*b* and an OUT flow path 80*c* inside the print head 8, thereby causing ink to circulate between the IN flow path 80*b* and the OUT flow path 80*c*.

The collection valve V4 is a valve for preventing a backflow at the time of not performing print operation, that is, at the time of not circulating ink within the circulation path. In the circulation path of the present embodiment, the sub-tank 151 is disposed higher than the print head 8 in a vertical direction (see FIG. 1). For this reason, in a case where the supply pump P1 and the collection pump P2 are not driven, there may be a possibility that ink flows back from the sub-tank 151 to the print head 8 due to a water head difference between the sub-tank 151 and the print head 8. In order to prevent such a backflow, the present embodiment provides the collection valve V4 in the collection flow path C4.

Further, in the collection flow path C4, a backflow prevention valve V7 is provided in the downstream relative to the collection valve V4. The backflow prevention valve V7 is a one-way valve, which lets ink flowing from the upstream to the downstream of the flow path pass through and blocks ink (backflow) flowing from the downstream to the upstream. As described above, the collection valve V4 (collection drive valve) is drive-controlled by the ink supply control unit 209 to close in order to prevent a backflow in a case where circulation is stopped. However, for example, in a case where the power source is turned off during circulation, a backflow may occur because the collection valve V4 does not close. Therefore, by providing the backflow prevention valve V7, which is a one-way valve, in the collection flow path C4, it is possible to prevent a backflow of ink into the print head 8 due to the water head difference even in a case where the collection valve V4 does not close. The backflow prevention valve V7 may be configured to include a spring and a sealing unit, for example. The backflow prevention valve V7 may be configured such that the sealing unit is urged by the spring and the flow path opens in a case where the sealing unit opens due to occurrence of a predetermined differential pressure between the upstream and the downstream of the backflow prevention valve V7.

Similarly, at the time of not performing print operation, that is, at the time of not circulating ink within the circulation path, the supply valve V2 also functions as a valve for preventing ink supply from the sub-tank 151 to the print head 8.

A head replacement flow path C5 is a flow path connecting the supply flow path C2 and an air chamber (a space in which ink is not contained) of the sub-tank 151, and in its midstream, the head replacement valve V5 is provided. One end of the head replacement flow path C5 is connected to the upstream of the print head 8 in the supply flow path C2, and arranged in the downstream relative to the supply valve V2. The other end of the head replacement flow path C5 is connected to an upper part of the sub-tank 151 in the direction of gravity, so as to communicate with the air chamber inside the sub-tank 151. The head replacement flow path C5 is used in the case of pulling out ink from the print head 8 in use such as upon replacing the print head 8 or transporting the printing apparatus 1. The head replacement valve V5 is controlled by the ink supply control unit 209 so as to be closed except for a case of ink filling in the printing apparatus 1 and a case of pulling out ink from the print head 8.

The cap unit 10 is connected to the flow path C6. In the flow path C6, a vacuum pump P3 (also referred to as a cap vacuum pump) is provided. The ink supply control unit 209 is capable of driving the vacuum pump P3 to generate a negative pressure in the cap unit 10. In the downstream (i.e., on the opposite side of the cap unit 10) of the vacuum pump P3 in the flow path C6, a maintenance cartridge CA is provided. In the maintenance cartridge CA, ink discharged through the flow path C6 is retained.

Next, a flow path configuration inside the print head 8 will be described. Ink supplied from the supply flow path C2 to the print head 8 passes through a filter 83 and then is supplied to a first negative pressure control unit 81 and a second negative pressure control unit 82. The first negative pressure control unit 81 is set to have a control pressure of a low negative pressure (i.e., a pressure with small pressure difference from the atmospheric pressure). The second negative pressure control unit 82 is set to have a control pressure of a high negative pressure (i.e., a pressure with large pressure difference from the atmospheric pressure). Pressures in those first negative pressure control unit 81 and second negative pressure control unit 82 are generated within a proper range by the driving of the collection pump P2.

In an ink ejection unit 80, a printing element substrate 80*a* in which a plurality of ejection openings are arrayed is arranged in plural to form an elongate ejection opening array. A common supply flow path 80*b* (IN flow path) for guiding ink supplied from the first negative pressure control unit 81 and a common collection flow path 80*c* (OUT flow path) for guiding ink supplied from the second negative pressure control unit 82 also extend in an arranging direction of the printing element substrates 80*a*. Furthermore, in the individual printing element substrates 80*a*, individual supply flow paths connected to the common supply flow path 80*b* and individual collection flow paths connected to the common collection flow path 80*c* are formed. Accordingly, in each of the printing element substrates 80*a*, an ink flow is generated such that ink flows in from the common supply flow path 80*b* which has relatively lower negative pressure and flows out to the common collection flow path 80*c* which has relatively higher negative pressure. In the midstream of a path between the individual supply flow path and the individual collection flow path, a pressure chamber which is communicated with each ejection opening and which is filled with ink is provided. An ink flow is generated in the ejection opening and the pressure chamber even in a case where printing is not performed. Once the ejection operation is performed in the printing element substrate 80*a*, a part of ink moving from the common supply flow path 80*b* to the common collection flow path 80*c* is ejected from the ejection opening and is consumed. Meanwhile, ink not having been ejected moves toward the collection flow path C4 via the common collection flow path 80*c*.

Figure 6A:
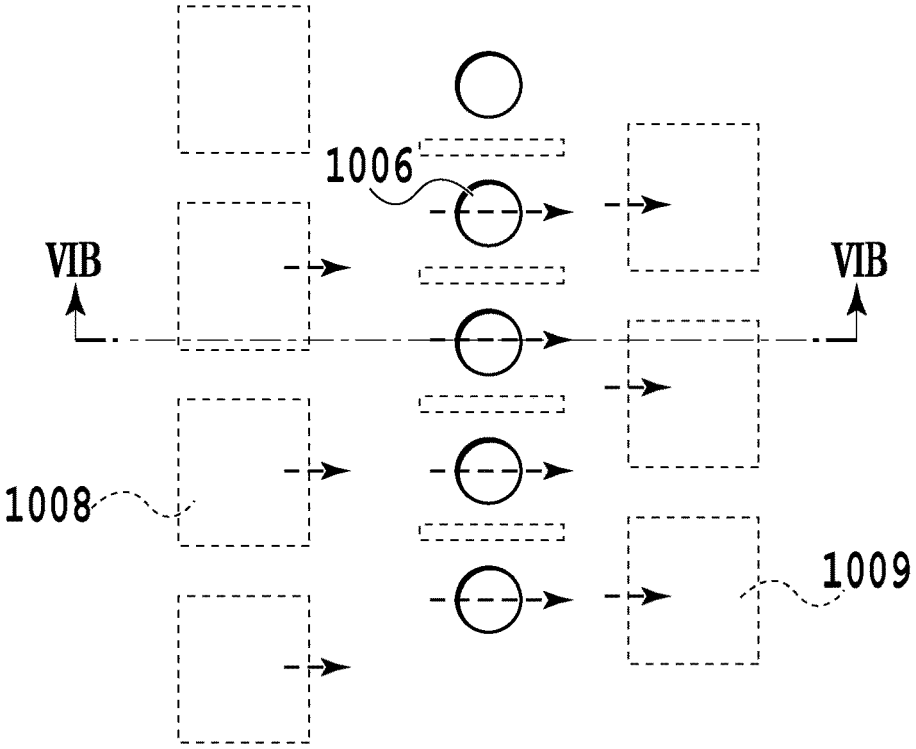
FIGS. 6A and 6B are diagrams for explaining an ejection opening and a pressure chamber.
Figure 6B:
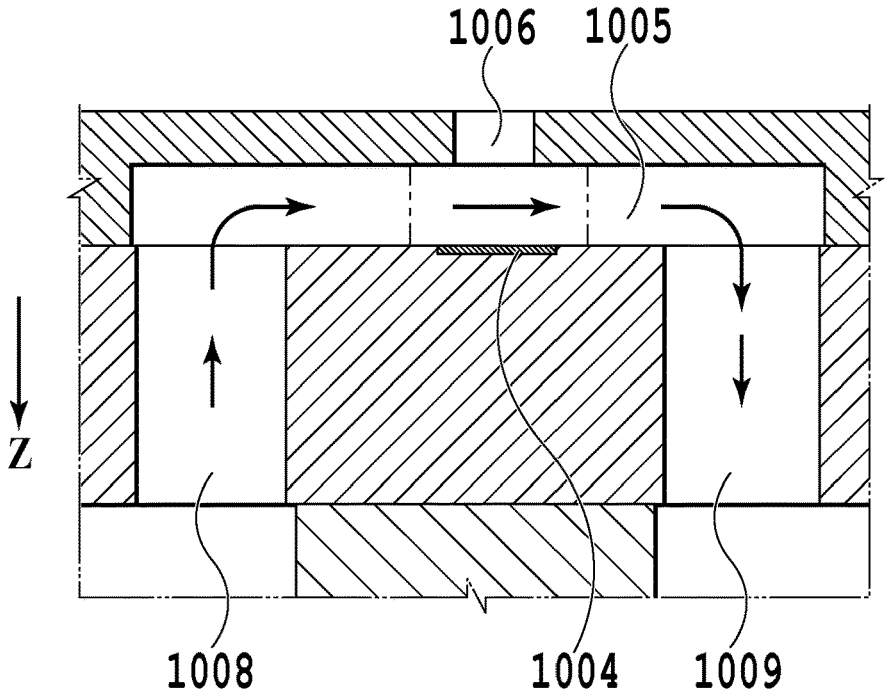

FIG. 6A is a plan schematic view enlarging a part of the printing element substrate 80*a*, and FIG. 6B is a sectional schematic view of a cross section taken from line VIB-VIB of FIG. 6A. In the printing element substrate 80*a*, a pressure chamber 1005 which is filled with ink and an ejection opening 1006 from which ink is ejected are provided. In the pressure chamber 1005, a printing element 1004 is provided at a position facing the ejection opening 1006. Further, in the printing element substrate 80*a*, a plurality of ejection openings 1006 are formed, each of which is connected to an individual supply flow path 1008 which is connected to the common supply flow path 80*b* and an individual collection flow path 1009 which is connected to the common collection flow path 80*c*.

According to the above configuration, in the printing element substrate 80*a*, an ink flow is generated such that ink flows in from the common supply flow path 80*b* which has relatively lower negative pressure (high pressure) and flows out to the common collection flow path 80*c* which has relatively higher negative pressure (low pressure). To be more specific, ink flows in the order of the common supply flow path 80*b*, the individual supply flow path 1008, the pressure chamber 1005, the individual collection flow path 1009, and the common collection flow path 80*c*. Once ink is ejected by the printing element 1004, part of ink moving from the common supply flow path 80*b* to the common collection flow path 80*c* is ejected from the ejection opening 1006 to be discharged outside the print head 8. Meanwhile, ink not having been ejected from the ejection opening 1006 is collected and flows into the collection flow path C4 via the common collection flow path 80*c*.

Under the above configuration, in performing print operation, the ink supply control unit 209 closes the tank supply valve V1 and the head replacement valve V5 and opens the atmosphere release valve V0, the supply valve V2, and the collection valve V4 to drive the supply pump P1 and the collection pump P2. As a result, the circulation path in the order of the sub-tank 151, the supply flow path C2, the print head 8, the collection flow path C4, and the sub-tank 151 is established. In a case where an amount of ink supply from the supply pump P1 per unit time is larger than the total value of an ejecting amount of the print head 8 per unit time and a flow rate in the collection pump P2 per unit time, ink flows from the supply flow path C2 into the relief flow path C3. As a result, the flow rate of ink from the supply flow path C2 to the print head 8 is adjusted.

In the case of not performing print operation, the ink supply control unit 209 stops the supply pump P1 and the collection pump P2 and closes the atmosphere release valve V0, the supply valve V2, and the collection valve V4. As a result, the ink flow inside the print head 8 stops and the backflow caused by the water head difference between the sub-tank 151 and the print head 8 is suppressed. Further, by closing the atmosphere release valve V0, ink leakage and ink evaporation from the sub-tank 151 are suppressed.

(Transportation Modes)

Next, an explanation is given of a situation in which the printing apparatus 1 with the ink supply unit 15 filled with ink is moved (transported) to another installation location. In a case where the printing apparatus 1 is transported in a state where the ink supply unit 15 is filled with ink, ink may leak from the ejection opening surface 8*a* of the print head 8. Therefore, in a case of transporting the printing apparatus 1, an operation of removing ink of the print head 8 is performed. In the present embodiment, two transportation modes, i.e., a first transportation mode and a second transportation mode, are provided as transportation modes. Additionally, the printing apparatus 1 is configured to be capable of selecting whether to operate in the first transportation mode or in the second transportation mode according to an instruction from the user. Further, the transportation modes are switched based on an instruction from the user.

The first transportation mode is a mode in which ink in the circulation flow path is discharged to the maintenance cartridge CA. Specifically, the first transportation mode is a mode in which ink in the sub-tank 151, in each of the flow paths C1 to C5 filled with ink, and in the print head 8 is discharged to the maintenance cartridge CA.

The first transportation mode is used, for example, in a case where the printing apparatus 1 is to be stored for a long period of time, not to be used immediately after transportation. In such a case where the printing apparatus 1 is stored for a long period of time after transportation, there is a possibility that ink remaining in the printing apparatus 1 is hardened. In addition, there is a possibility that the expiration date of the ink remaining in the printing apparatus 1 elapses. Therefore, in such a case where the printing apparatus 1 is to be stored for a long period of time after transportation, the first transportation mode is used.

Further, the first transportation mode is used, for example, in a case where the printing apparatus 1 is tilted or laid down, etc., for transportation. In a case where the main body of the printing apparatus 1 needs to be laid down during transportation, there is a possibility that ink remaining in the printing apparatus 1 leaks out of the apparatus. Therefore, in such a case where the main body of the printing apparatus 1 is to be laid down during transportation, the first transportation mode is used.

The second transportation mode is a mode in which ink in the circulation flow path is pulled out to the sub-tank 151. Specifically, the second transportation mode is a mode in which ink in a part of the supply flow path C2 filled with ink, in the collection flow path C4, in the head replacement flow path C5, and in the print head 8 is pulled out to the sub-tank 151. This is to prevent ink from leaking out of the ejection opening surface 8*a* of the print head 8 during transportation. In a case of the second transportation mode, ink retained in the sub-tank 151 can be reused after the printing apparatus 1 is transported and then installed.

Figures 7A, 7B, 7C, 7D:
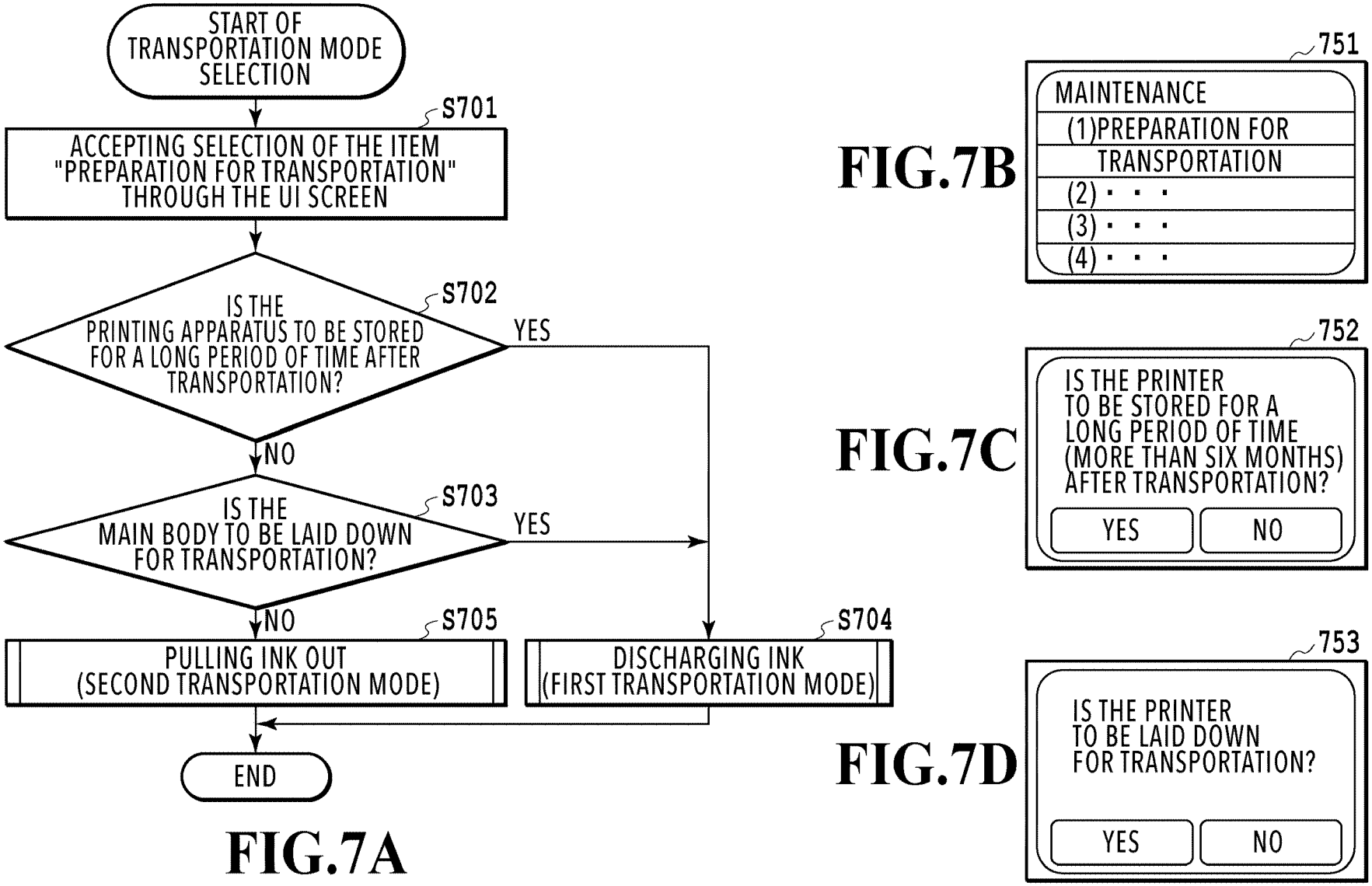
FIGS. 7A through 7D are diagrams for explaining transportation mode selection processing.

FIGS. 7A through 7D are diagrams for explaining transportation mode selection (determination) processing in the present embodiment. FIG. 7A is a flowchart showing an example of the transportation mode selection processing performed by the main controller 101. Each of FIGS. 7B through 7D is a diagram showing an example of a UI screen for selecting a transportation mode. Each of the UI screens shown in FIGS. 7B through 7D is displayed on the operating panel 104. The series of processing shown in the flowchart of FIG. 7A is performed by the main controller 101 retrieving a program code stored in the ROM 107 into the RAM 106 and executing the program code. The symbol "S" in the explanation of each process means that it is a step in the flowchart (the same applies hereinafter in the present specification).

The user can operate the operating panel 104 to display various menu screens on the operating panel 104. In a case where a menu related to maintenance is selected by the user from an operation menu, a UI screen 751 shown in FIG. 7B is displayed on the operating panel 104, for example. The UI screen 751 includes a menu of various kinds of maintenance. Here, "PREPARATION FOR TRANSPORTATION" is specified as a representative example, and the other items are omitted in the illustration of FIG. 7B. The processing shown in FIG. 7A correspond to processing performed after the UI screen 751 is displayed.

In S701, the main controller 101 accepts that the user has selected the item "PREPARATION FOR TRANSPORTATION" through the UI screen 751 on the operating panel 104. Then, the main controller 101 displays the UI screen 752 shown in FIG. 7C on the operating panel 104. The UI screen 752 is a screen for accepting selection as to whether the printing apparatus 1 is to be stored for a long period of time (i.e., six months or more) after transportation. In addition, although here six months or more is regarded as a long period of time, the present embodiment is not limited to this example. That is, the period may be shorter than six months and longer than six months.

In S702, the main controller 101 determines whether the user has selected to store the printing apparatus 1 for a long period of time after transportation or not. In a case where the selection by the user is indicative of storing the printing apparatus 1 for a long period of time after transportation, the processing proceeds to S704. In S704, the main controller 101 determines the first transportation mode as the transportation mode. Then, the main controller 101 causes the ink supply control unit 209 to perform processing of the first transportation mode. That is, the processing for discharging ink in the circulation flow path to the maintenance cartridge CA is performed.

On the other hand, in S702, in a case where the selection by the user is indicative of not storing the printing apparatus 1 for a long period of time after transportation, the processing proceeds to S703. In S703, the main controller 101 displays the UI screen 753 shown in FIG. 7D on the operating panel 104. The UI screen 753 is a screen for accepting selection as to whether the printing apparatus 1 is to be laid down for transportation.

In S703, the main controller 101 determines whether the user has selected to lay down the printing apparatus 1 for transportation or not. In a case where the selection by the user is indicative of laying down the printing apparatus 1 for transportation, the processing proceeds to S704. In S704, the main controller 101 determines the first transportation mode as the transportation mode. Then, the main controller 101 causes the ink supply control unit 209 to perform processing of the first transportation mode. Contrarily, in a case where the selection by the user is indicative of not laying down the printing apparatus 1 for transportation, the processing proceeds to S705. In S705, the main controller 101 determines the second transportation mode as the transportation mode. Then, the main controller 101 causes the ink supply control unit 209 to perform processing of the second transportation mode. That is, the processing for pulling out ink in the circulation flow path to the sub-tank 151 is performed.

The order of the processing shown in FIG. 7A is not limited to the above. S702 and S703 may be reversed. That is, there may be a mode in which the user is asked to select whether the printing apparatus 1 is to be laid down for transportation, and, in a case where the user does not lay down the printing apparatus 1 for transportation, the user is asked to select whether the printing apparatus 1 is to be stored for a long period of time.

(First Transportation Mode)

Next, an explanation is given of the processing of the first transportation mode performed in S704. In the first transportation mode, two major operations are performed. The first operation is an operation in which the vacuum pump P0 (tank vacuum pump) is made to operate with the supply valve V2 (also referred to as a supply drive valve) being closed, so as to pull out ink in the flow path of the ejection opening surface 8*a* up to the collection flow path C4 into the sub-tank 151. The second operation is an operation in which the vacuum pump P3 (cap vacuum pump) is made to operate with the collection valve V4 (also referred to as a collection drive valve) being closed, so as to suction ink in the flow path of the sub-tank 151 up to the ejection opening surface 8*a* by use of the cap unit 10. In the first operation, ink in the collection flow path C4 is once pulled out into the sub-tank 151 so that ink is collected in the sub-tank 151. Thereafter, an operation of suctioning ink in the sub-tank 151, which includes the collected ink, in the second operation and discharging the ink to the maintenance cartridge CA is performed. In the following, an explanation is given of processing of the first transportation mode with reference to the drawings.

Figure 8:
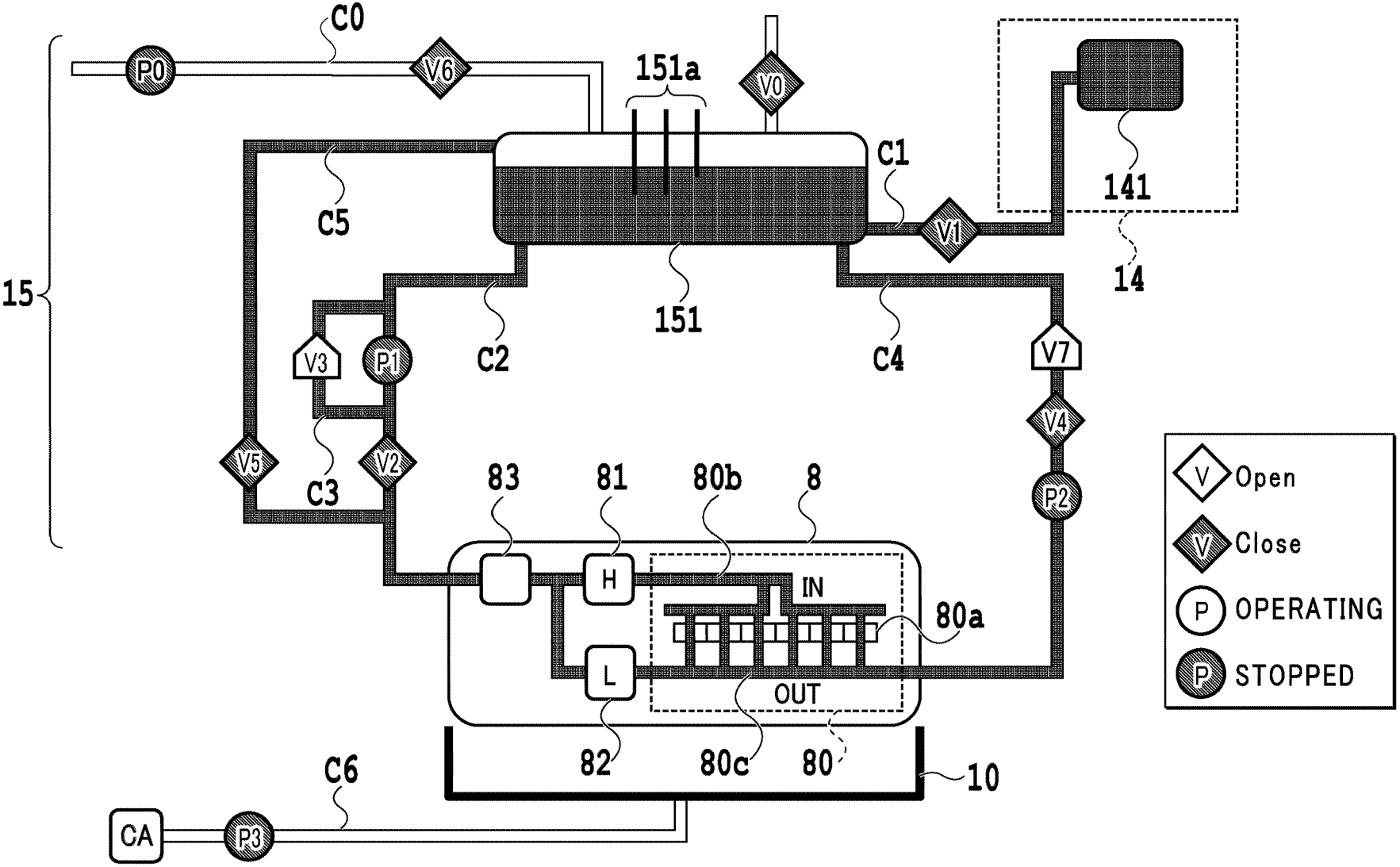
FIG. 8 is a diagram showing a state of the ink circulation system.

FIG. 8 is a diagram showing a state in which ink is filled in the circulation flow path. FIG. 8 shows a state in which a predetermined operation such as a print operation is terminated and circulation is stopped, for example. That is, the atmosphere release valve V0, the tank supply valve V1, the supply valve V2, the collection valve V4, the head replacement valve V5, and the sub-tank vacuum valve V6 are closed (CLOSE). Further, the vacuum pump P0, the supply pump P1, the collection pump P2, and the vacuum pump P3 are stopped. The hatched parts in the print head 8, in each tank, and in each flow path are indicative of parts filled with ink. In the following, an explanation is given of a mode in which the state of FIG. 8 is the initial state for performing the processing of discharging ink. The processing explained below is performed for ink of each color.

Figure 9:
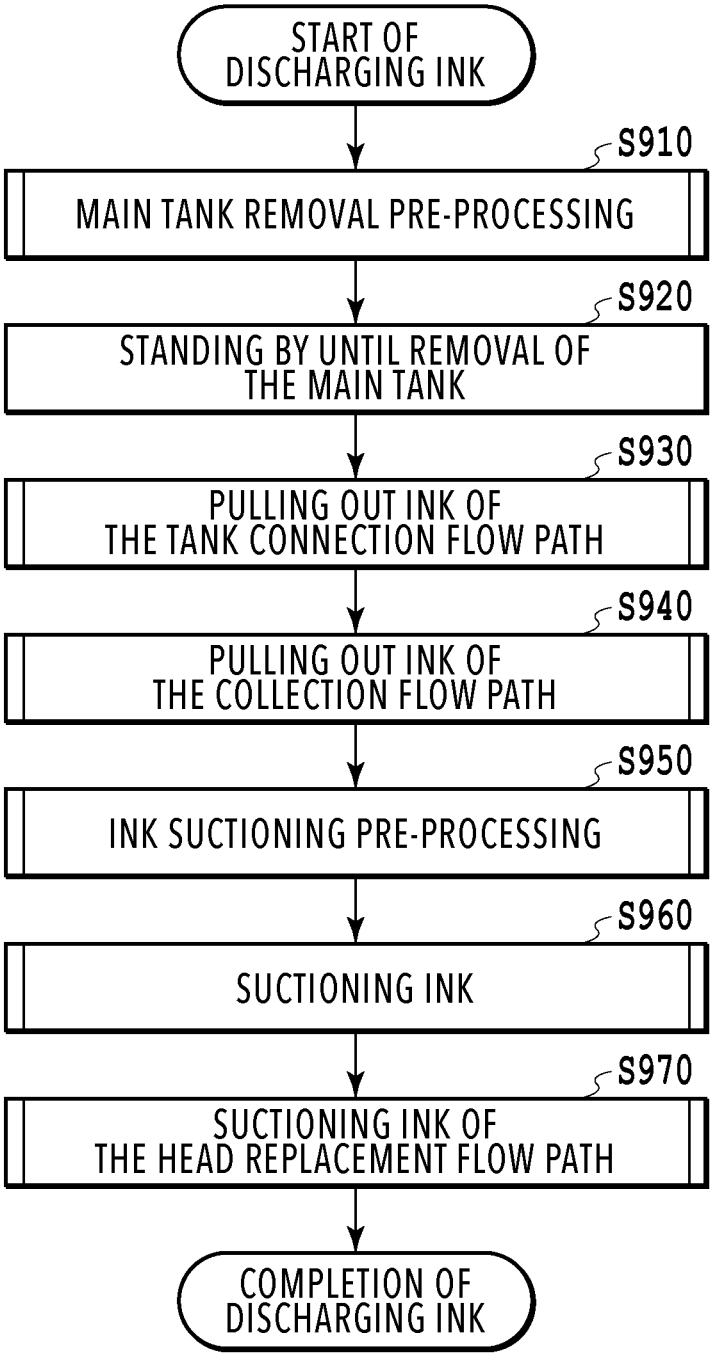
FIG. 9 is a flowchart of a first transportation mode.

FIG. 9 is a flowchart showing the entire processing in the first transportation mode performed in S704. The processing of FIG. 9 is performed by the ink supply control unit 209. The ink supply control unit 209 controls driving and stopping of various pumps, which includes: the vacuum pump P0 (tank vacuum pump) for reducing pressure inside of the sub-tank 151; and the vacuum pump P3 (cap vacuum pump) for reducing pressure inside the cap unit 10. Further, control by the ink supply control unit 209 enables opening and closing of various valves. The control over the cap unit 10 is performed by the maintenance control unit 210 based on control by the ink supply control unit 209. However, for the sake of simplicity for explanation, an explanation is given under the assumption that the ink supply control unit 209 controls the cap unit 10. Firstly, an overview of the entire processing is explained with reference to FIG. 9. Details of each process is described later.

The main tank removal pre-processing is performed in S910. Thereafter, in S920, the ink supply control unit 209 stands by until the main tank 141 is removed by the user. Then, in S930, the processing of pulling out ink in the tank connection flow path C1 into the sub-tank 151 is performed. In S940, the processing of pulling out ink in the flow path of the ejection opening surface 8*a* up to the collection flow path C4 into the sub-tank 151 is performed.

In S950, ink suctioning pre-processing for suctioning ink into the cap unit 10 is performed. In S960, ink suctioning processing for suctioning ink into the cap unit 10 is performed. In the ink suctioning processing, processing of discharging ink in the flow path of the sub-tank 151, the supply flow path C2, the relief flow path C3, and up to the ejection opening surface 8*a* of the print head 8 into the maintenance cartridge CA is performed. In S970, the ink suctioning processing for suctioning ink in the head replacement flow path C5 into the cap unit 10 is performed.

Through the above processing, ink in each flow path is discharged to the maintenance cartridge CA. Below is an explanation of each process in detail. In the processes to be described in detail below, an explanation is mainly given of the opened or closed state of related valves and the driving state of related pumps. Unless otherwise specifically mentioned, the valves are in the closed states and the pumps are in the stopped states as shown in FIG. 8. In addition, it is assumed that the printing apparatus 1 is in the standby state shown in FIG. 1 as well as in a state where the ejection opening surface 8*a* is capped by the cap unit 10.

Figure 10:
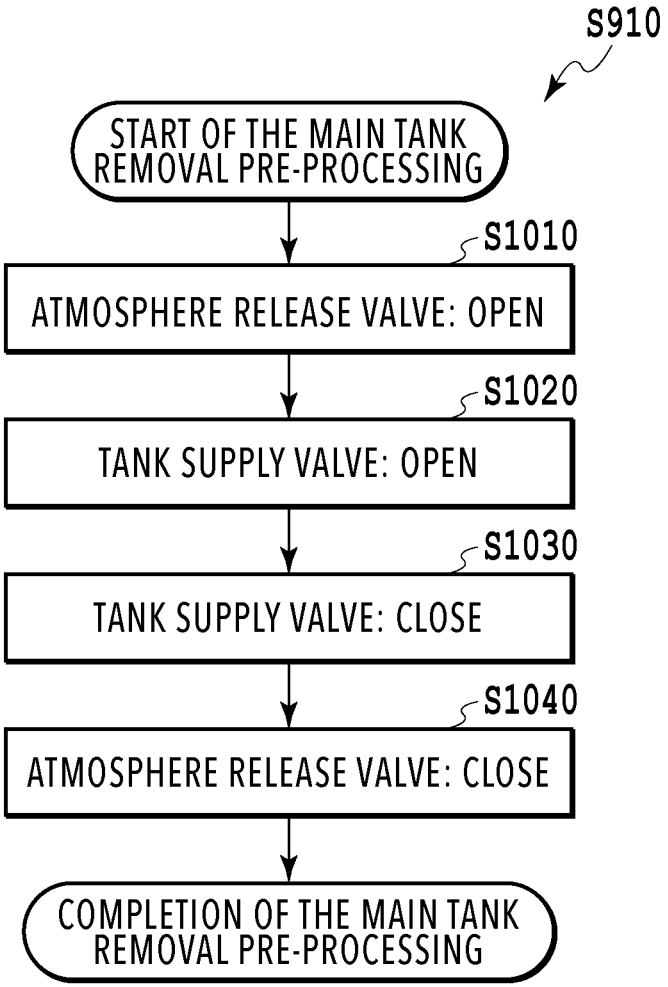
FIG. 10 is a flowchart of main tank removal pre-processing.

FIG. 10 is a detailed flowchart of the main tank removal pre-processing of S910. The main tank removal pre-processing is processing performed to release the pressure in the tank connection flow path C1. If the inside of the tank connection flow path C1 is in a pressurized state, there is a possibility that ink drips from the main tank insertion port (not sown in the drawings) in a case where the user removes the main tank 141. Therefore, the processing of releasing the pressure in the tank connection flow path C1 is performed.

In S1010, the ink supply control unit 209 opens the atmosphere release valve V0 so that the inside of the sub-tank 151 communicates with the atmosphere. In S1020, the ink supply control unit 209 opens the tank supply valve V1 (also referred to as a tank supply drive valve). Through the above operation, the pressure inside the tank connection flow path C1 is released. Then, in S1030, the ink supply control unit 209 closes the tank supply valve V1. In S1040, the ink supply control unit 209 closes the atmosphere release valve V0. Thus, the main tank removal pre-processing is completed.

Subsequently, in S920, the ink supply control unit 209 stands by until the main tank 141 is removed by the user. Specifically, the ink supply control unit 209 transmits, to the main controller 101, a notification that the ink supply control unit 209 has been standing by for removal of the main tank 141. In response to the notification, the main controller 101 unlocks and opens the door (not shown in the drawings) of the exterior part for inserting and removing the main tank 141. Furthermore, the main controller 101 displays, on the operating panel 104, a message for prompting the user to remove the main tank 141. The operation of removing the main tank 141 would be performed by the user who sees the message.

Then, in a case where it is detected that the door of the exterior part is closed by the user after removing the main tank 141, whether the main tank 141 is removed from the printing apparatus 1 or not is detected. Specifically, whether the printing apparatus 1 and the main tank 141 are electrically connected or not is detected. In a case where it is detected that the main tank 141 is properly removed, the main controller 101 notifies the ink supply control unit 209 that removal of the main tank 141 has been completed. Contrarily, in a case where the main tank 141 is not removed, the main controller 101 unlocks the door of the exterior part again and displays, on the operating panel 104, a message for prompting the user to remove the main tank 141.

Alternatively, the main controller 101 may display, on the operating panel 104, a UI screen (not shown in the drawings) for confirming with the user whether the user has removed the main tank 141 or not. In a case where the user inputs an instruction (for example, pressing an OK button) indicating that the user has removed the main tank 141, the main controller 101 notifies the ink supply control unit 209 that removal of the main tank 141 has been completed. In S920, the ink supply control unit 209 stands by until receiving the notification that removal of the main tank 141 has been completed.

The connection point of the main tank 141 and the tank connection flow path C1 is located above the sub-tank 151 in the vertical direction. Therefore, ink in the tank connection flow path C1 barely leaks out after the main tank 141 is removed.

Figure 11:
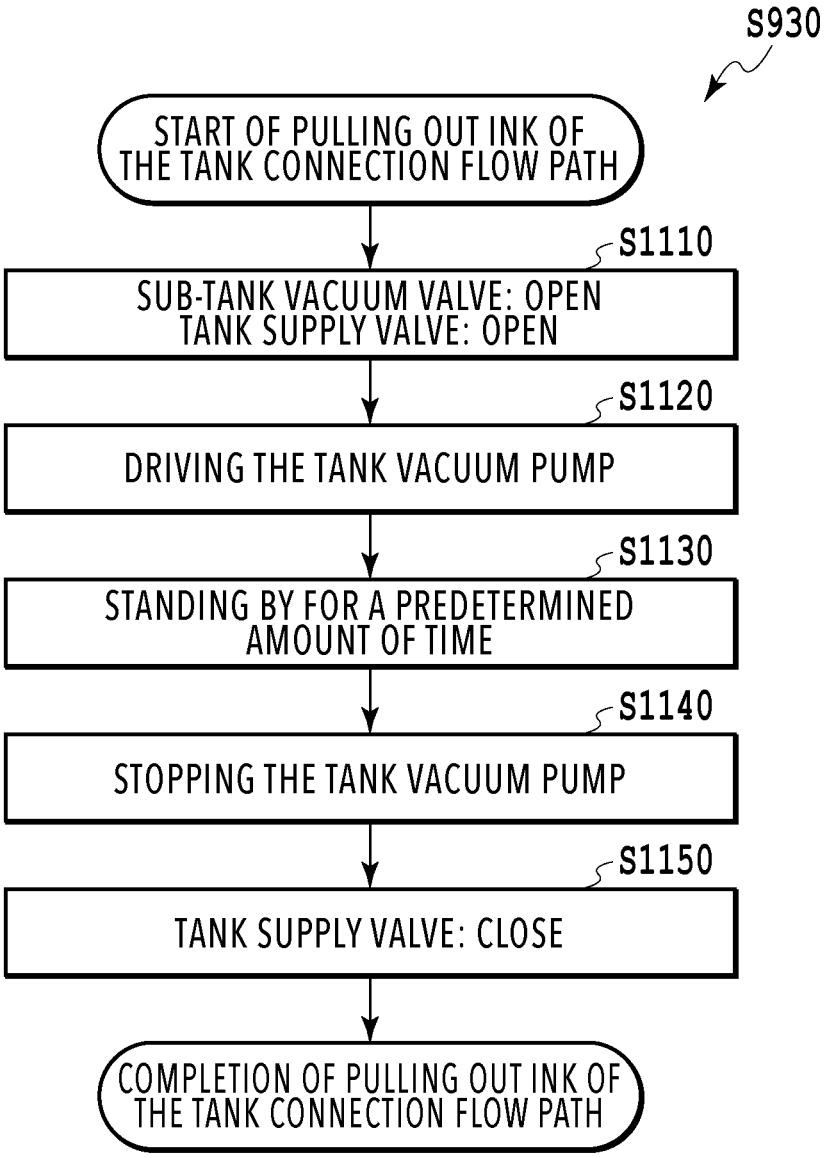
FIG. 11 is a flowchart for explaining processing of pulling out ink of a tank connection flow path.

FIG. 11 is a flowchart for explaining the processing of pulling out ink of the tank connection flow path C1 in S930, which is performed after S920. In the process of S930, processing of pulling out ink in the tank connection flow path C1 into the sub-tank 151 is performed.

In S1110, the ink supply control unit 209 opens the sub-tank vacuum valve V6 and the tank supply valve V1. In S1120, the ink supply control unit 209 drives the vacuum pump P0 (tank vacuum pump).

Figure 12:
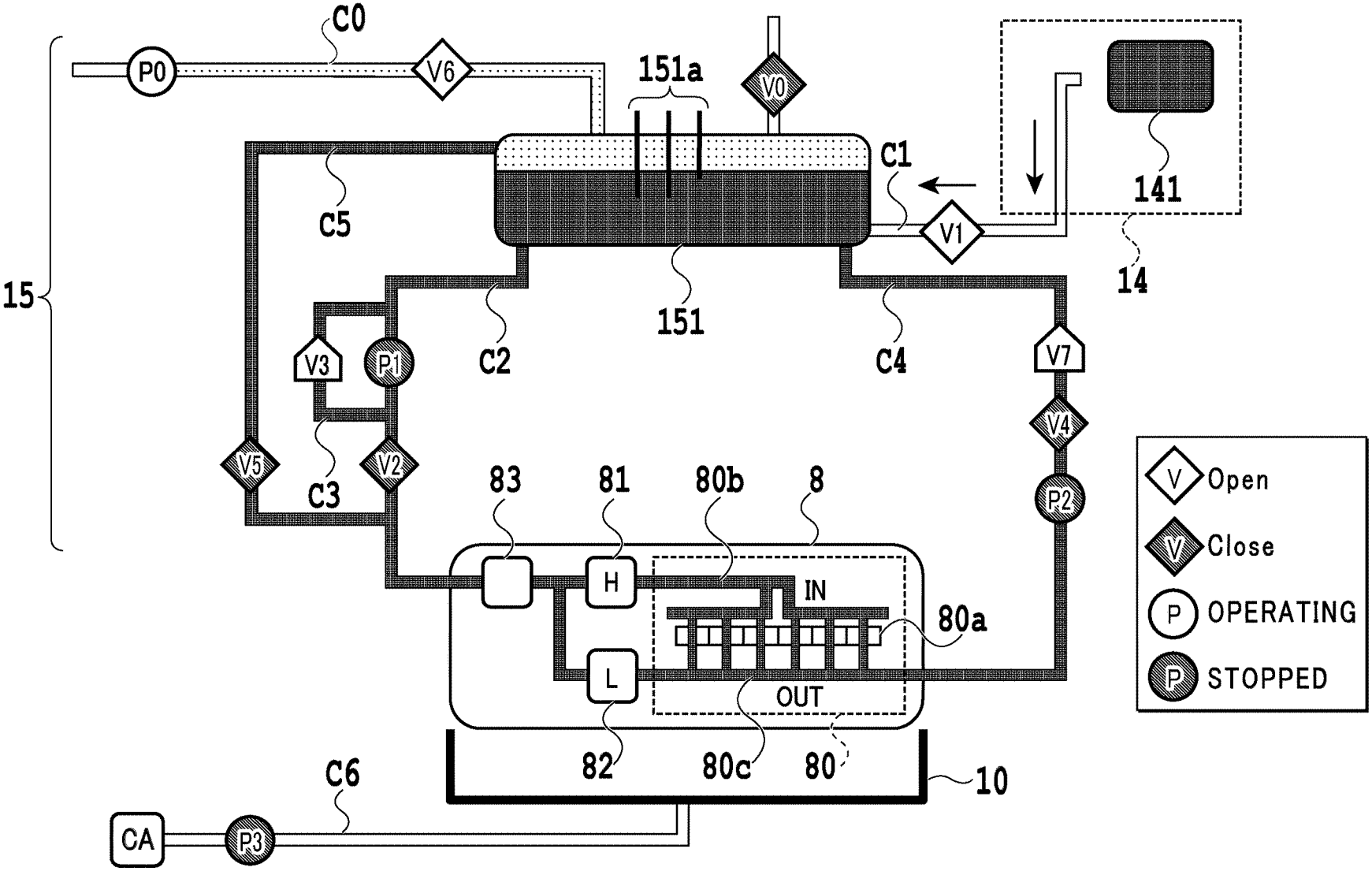
FIG. 12 is a diagram showing a state of the ink circulation system.

FIG. 12 is a diagram showing a state where ink is being pulled out in S1120. The lightly hatched area in FIG. 12 is indicative of a space with a negative pressure. A negative pressure is generated in the sub-tank 151 by driving the vacuum pump P0 (tank vacuum pump). As a result, the atmosphere flows into the tank connection flow path C1 from the connection port between the main tank 141 and the tank connection flow path C1. Therefore, ink filled in the tank connection flow path C1 is pulled out to the sub-tank 151 together with the atmosphere that has flown in.

In S1130, the ink supply control unit 209 stands by for a predetermined amount of time. The predetermined amount of time may be an amount of time for ink filled in the tank connection flow path C1 to be pulled out into the sub-tank 151, which is measured in advance. In S1140, the ink supply control unit 209 stops the vacuum pump P0 (tank vacuum pump). In S1150, the ink supply control unit 209 closes the tank supply valve V1. Through the above operation, ink in the tank connection flow path C1 is pulled out into the sub-tank 151.

Figure 13:
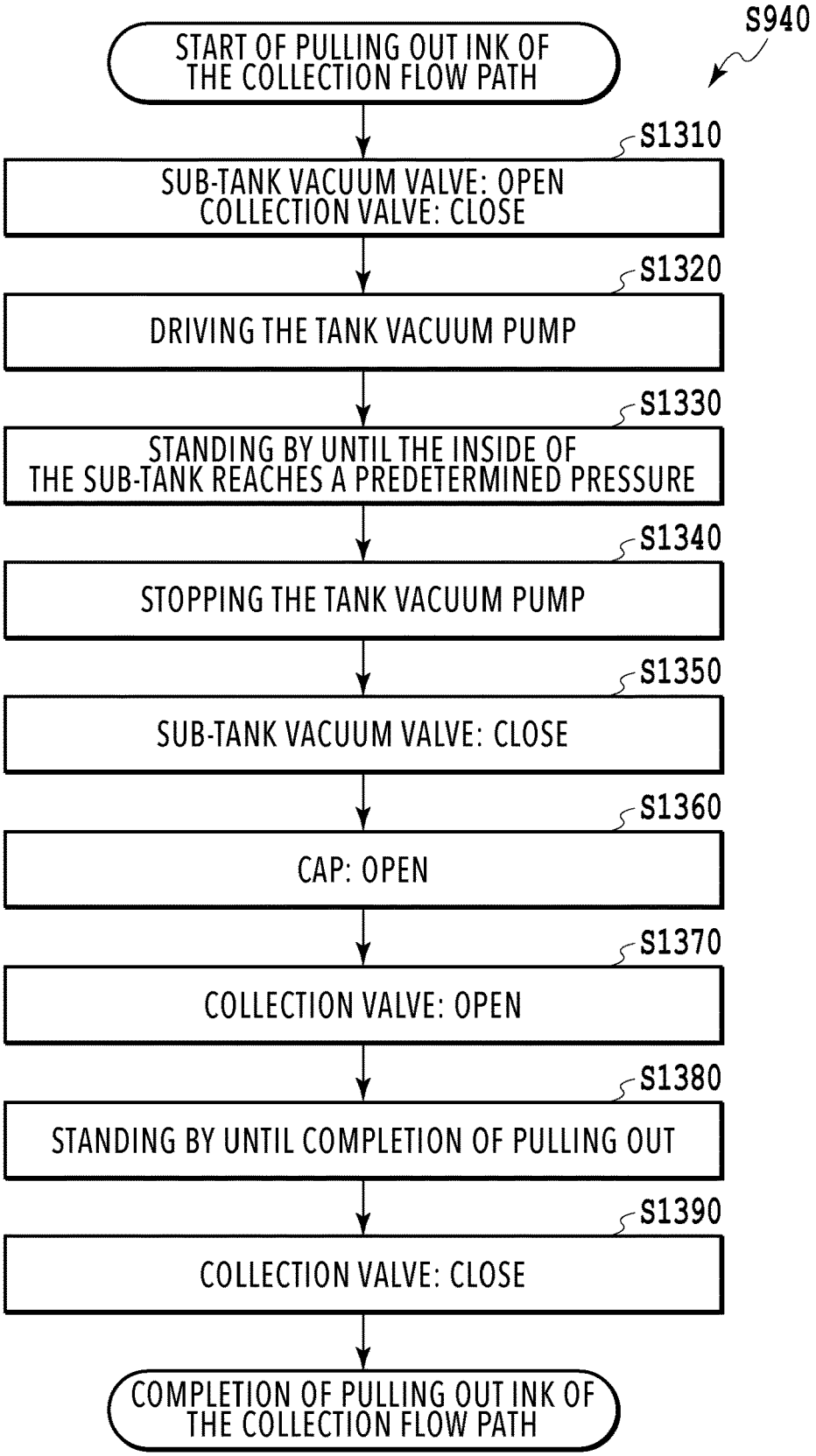
FIG. 13 is a flowchart for explaining processing of pulling out ink of a collection flow path.

FIG. 13 is a flowchart for explaining the processing of pulling out ink of the collection flow path C4 in S940, which is performed after S930. In the process of S940, the processing of pulling out ink in the flow path of the ejection opening surface 8*a* up to the collection flow path C4 into the sub-tank 151 is performed. As described above, in the first transportation mode, ink in the circulation flow path is suctioned by the cap unit 10 and discharged to the maintenance cartridge CA at the end. Here, in the present embodiment, ink in the flow path of the ejection opening surface 8*a* up to the collection flow path C4 is not discharged directly into the cap unit 10 but is once pulled out into the sub-tank 151. One of the reasons for this is that the backflow prevention valve V7 is provided in the collection flow path C4. In the present embodiment, as described above, the sub-tank 151 is arranged above the print head 8 in the vertical direction. Further, in preparation for a case where the power source is turned off during circulation, the backflow prevention valve V7 is provided in the collection flow path C4. As a result, even in a case where the collection valve V4 does not close, a backflow of ink into the print head 8 is prevented. As described above, the backflow prevention valve V7 lets ink flowing from the print head 8 to the sub-tank 151 pass through but blocks ink flowing from the sub-tank 151 to the print head 8. Therefore, for example, even with an attempt of discharging ink in the collection flow path C4 into the cap unit 10 by reducing pressure in the cap unit 10, ink in the collection flow path C4 on the downstream side (i.e., on the sub-tank 151 side) relative to the backflow prevention valve V7 is not discharged into the cap unit 10. As a result, there is an occurrence of ink remaining in the collection flow path C4. Therefore, in the present embodiment, the processing of once pulling out ink in the flow path of the ejection opening surface 8*a* up to the collection flow path C4 into the sub-tank 151 is performed.

Since the backflow prevention valve V7 is provided in the collection flow path C4, the processing of once pulling out ink of the collection flow path C4 into the sub-tank 151 is taken as an example in the explanation of the present embodiment. However, the present embodiment is not limited to the example. For example, in a case where a flow path has a complicated configuration, ink may not be sufficiently discharged only by suctioning in one direction (for example, from the cap unit 10 side). Therefore, in such a case where a flow path has a complicated configuration, there may be a configuration in which ink is suctioned and discharged in a predetermined direction (i.e., from the cap unit 10 side) after being once pulled out in the other direction (i.e., to the sub-tank 151 side).

An explanation is given of the processing of FIG. 13. In S1310, the ink supply control unit 209 opens the sub-tank vacuum valve V6. The collection valve V4 is kept closed. In S1320, the ink supply control unit 209 drives the vacuum pump P0 (tank vacuum pump) to generate a negative pressure in the sub-tank 151. In S1330, the ink supply control unit 209 stands by until the inside of the sub-tank 151 reaches a predetermined negative pressure. In S1340, the ink supply control unit 209 stops the vacuum pump P0. In S1350, the ink supply control unit 209 closes the sub-tank vacuum valve V6. Accordingly, the closed space formed by the vacuum pump P0 (the sub-tank vacuum valve V6), the head replacement valve V5, the supply valve V2, and the collection valve V4 reaches a predetermined negative pressure. In S1360, the ink supply control unit 209 separates the cap unit 10 from the ejection opening surface 8*a*. The separation of the cap unit 10 may be performed between S1310 and S1320. In S1370, the ink supply control unit 209 opens the collection valve V4. Accordingly, pulling out of ink on the collection flow path C4 side (i.e., the downstream flow path side) is initiated due to the negative pressure charged in the closed space.

Figure 14:
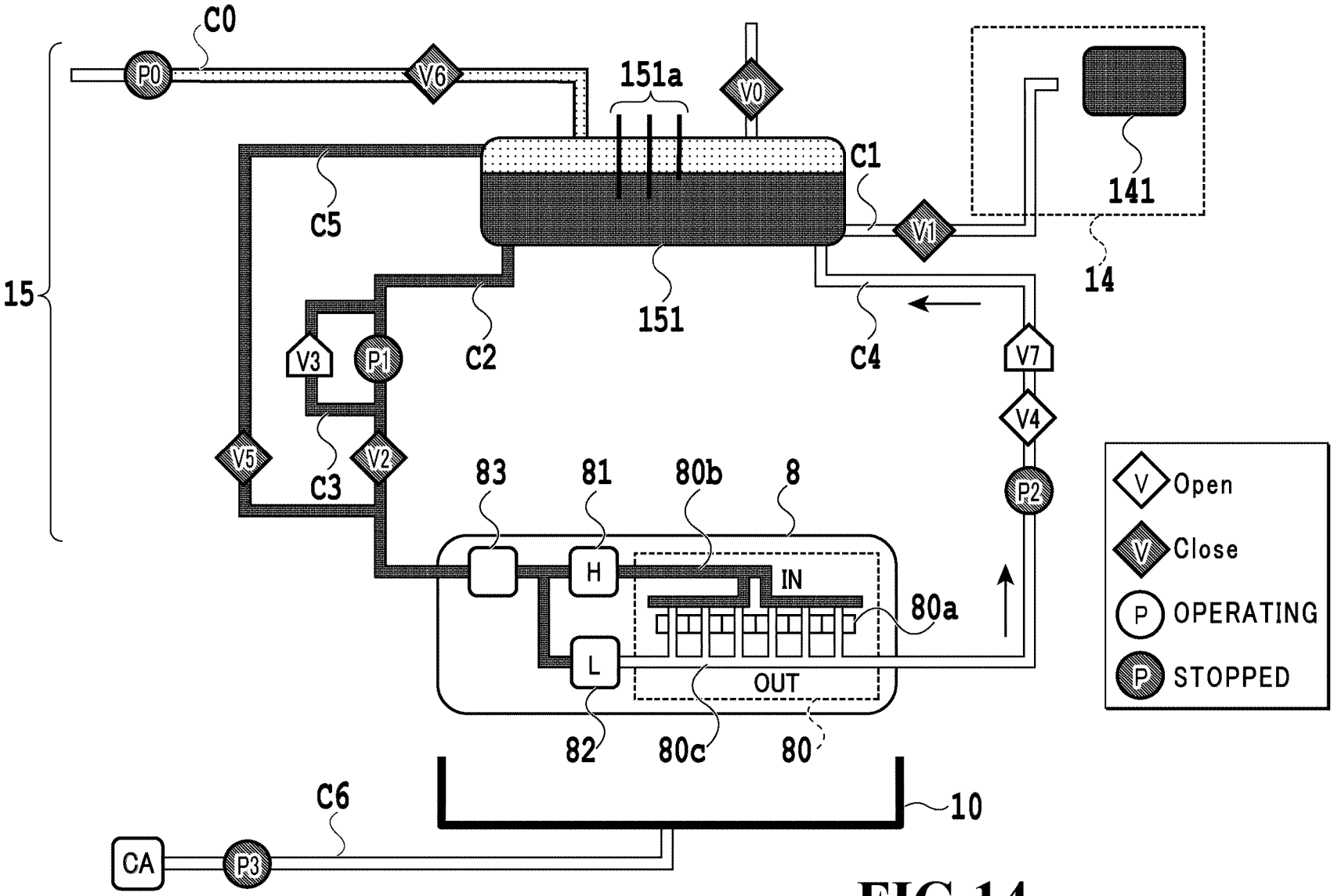
FIG. 14 is a diagram showing a state of the ink circulation system.

FIG. 14 is a diagram showing a state where ink is being pulled out in S1370. Since the collection valve V4 is opened, the meniscus formed on the ejection opening surface 8*a* of the print head 8 is broken by the negative pressure charged in the closed space. Then, the atmosphere flows in from the ejection opening surface 8*a* where the meniscus is broken, so that ink filled in the print head 8 is pulled out into the sub-tank 151 via the collection flow path C4 together with the atmosphere that has flown in. That is, ink in the flow path of the ejection opening surface 8*a* up to the collection flow path C4 is pulled out into the sub-tank 151. Since ink is pulled out from the ejection opening surface 8*a* as described above, ink partially remains in the flow path inside the print head 8 on the upstream side relative to the ejection opening surface 8*a*, as shown in FIG. 14.

In S1380, the ink supply control unit 209 stands by for a predetermined amount of time until pulling out of ink is completed. Then, in S1390, the ink supply control unit 209 closes the collection valve V4.

In the present embodiment, regarding pulling out of ink in the flow path of the ejection opening surface 8*a* up to the collection flow path C4, an explanation has been given of a mode in which ink on the collection flow path C4 side is pulled out by using the vacuum pump P0 to generate a negative pressure in the sub-tank 151. According to such a configuration, even in a case where the collection pump P2 is a pump having low output power or in a case where flow resistance is large because a flow path is long or narrow, etc., ink can be properly pulled out. However, it is not necessary that the collection pump P2 is kept in a stopped state at the time of pulling ink out. That is, there may be a mode in which the collection pump P2 is driven at the time of pulling out ink of the collection flow path C4. That is, after the collection valve V4 is opened in S1370, the collection pump P2 may be driven and then stopped after standing by for the predetermined amount of time in S1380. By driving the collection pump P2, the collection pump P2 can play an auxiliary role in pulling ink out.

Figure 15:
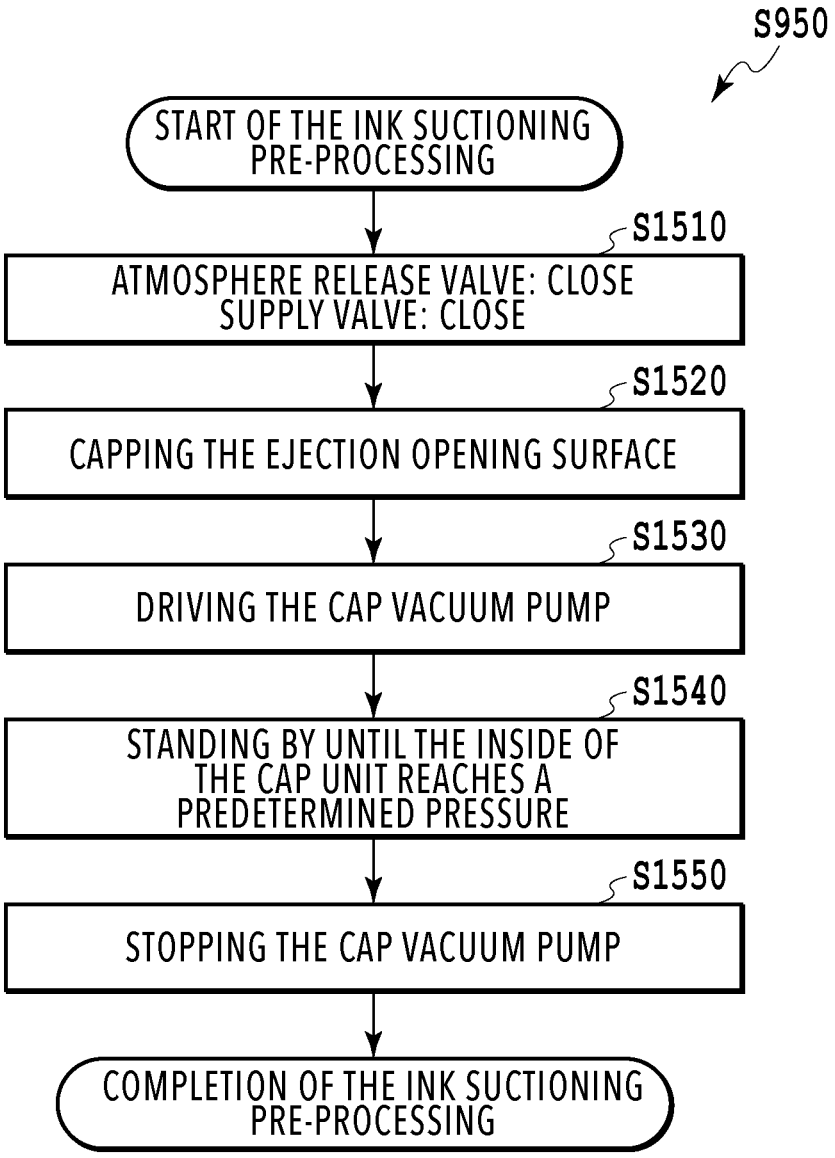
FIG. 15 is a flowchart for explaining ink suctioning pre-processing.

FIG. 15 is a flowchart for explaining the ink suctioning pre-processing in S950, which is performed after S940. The ink suctioning pre-processing in S950 is pre-processing for the ink suctioning processing to be performed subsequently. In the ink suctioning pre-processing, the ejection opening surface 8*a* is capped by the cap unit 10 and a negative pressure is charged in the flow path including the cap unit 10.

In S1510, the ink supply control unit 209 keeps the atmosphere release valve V0 and the supply valve V2 closed. In S1520, the ink supply control unit 209 caps the ejection opening surface 8*a* with the cap unit 10. In S1530, the ink supply control unit 209 drives the vacuum pump P3 (cap vacuum pump). In S1540, the ink supply control unit 209 stands by until the inside of the cap unit 10 reaches a predetermined negative pressure. Then, in S1550, the ink supply control unit 209 stops the vacuum pump P3.

Figure 16:
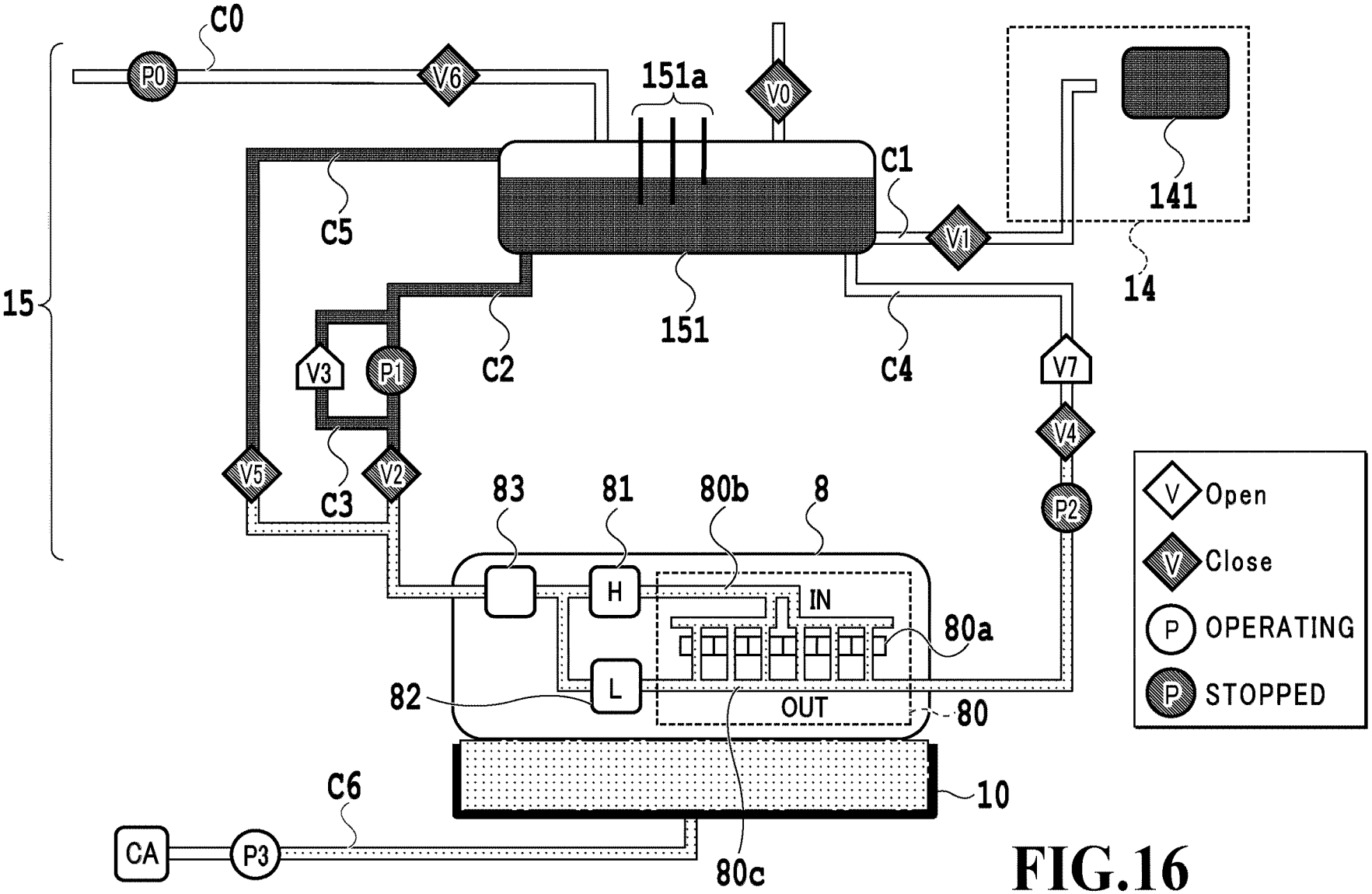
FIG. 16 is a diagram showing a state of the ink circulation system.

FIG. 16 is a diagram showing a state in which a negative pressure is charged in S1540. The closed space inside the cap unit 10, on the downstream side relative to the supply valve V2 and the head replacement valve V5, inside the print head 8, and on the upstream side relative to the collection valve V4 has a predetermined negative pressure. Although overlaid with the space with a negative pressure in FIG. 16, the ink in the print head 8 and the ink filled in the downstream of the supply valve V2 and the head replacement valve V5 remain in the flow path as shown in FIG. 14 at this point in time.

Figure 17:
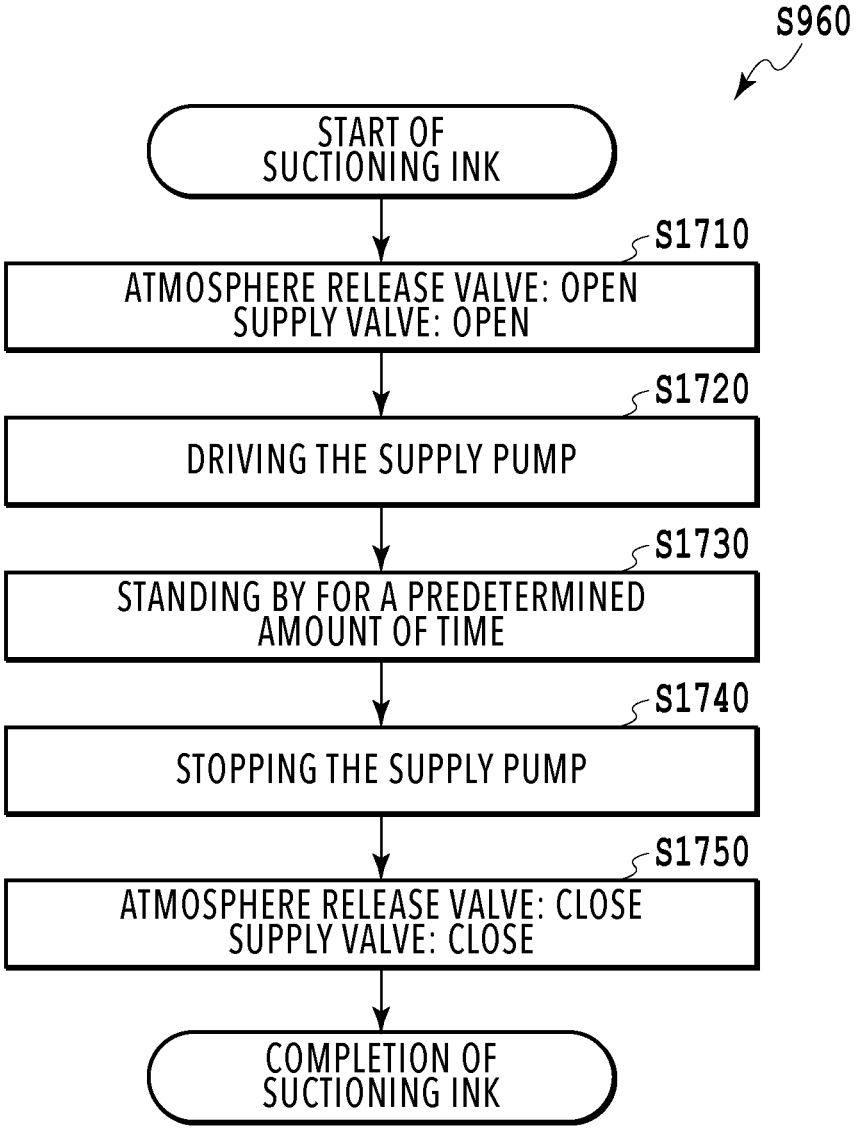
FIG. 17 is a flowchart for explaining ink suctioning processing.

FIG. 17 is a flowchart for explaining the ink suctioning processing in S960, which is performed after S950. The ink suctioning processing in S960 is processing of suctioning ink of the sub-tank 151 up to the print head 8 toward the cap unit 10 and discharging the ink to the maintenance cartridge CA.

In S1710, the ink supply control unit 209 opens the atmosphere release valve V0 and the supply valve V2. Through the above operation, the processing of discharging ink into the cap unit 10 by the negative pressure charged in the closed space is performed. Further, in S1720, the ink supply control unit 209 drives the supply pump P1. In S1710, the atmosphere flows in from the atmosphere release valve V0, and ink filled in the sub-tank 151, in the supply flow path C2, and in the print head 8 is discharged through the cap unit 10 and through the flow path C6 into the maintenance cartridge CA together with the atmosphere that has flown in. In addition, by driving the supply pump P1, the flow of the ink can be promoted. In S1730, the ink supply control unit 209 stands by for a predetermined amount of time. In S1740, the ink supply control unit 209 stops the supply pump P1. In S1750, the ink supply control unit 209 closes the atmosphere release valve V0 and the supply valve V2.

Figure 18:
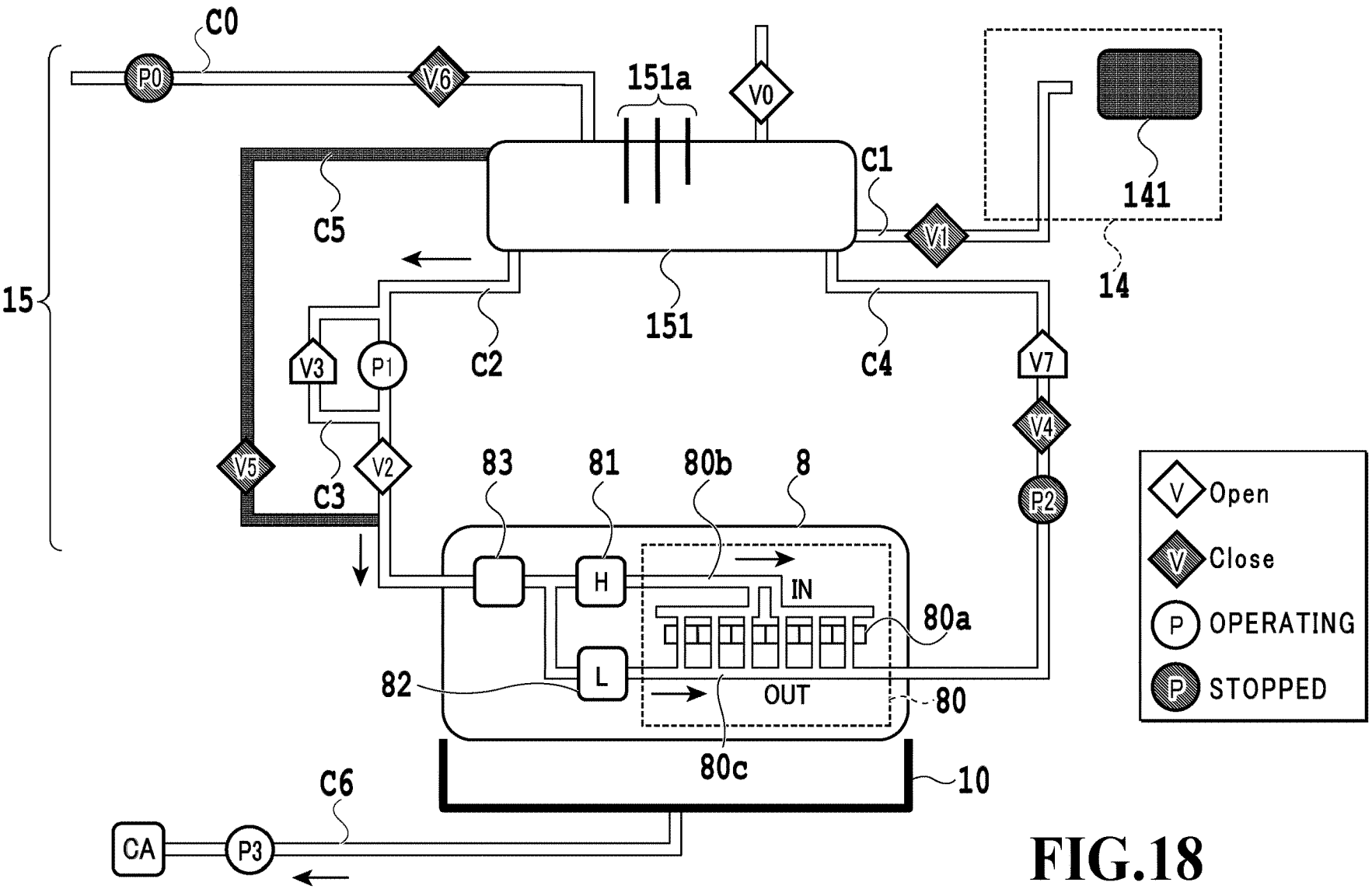
FIG. 18 is a diagram showing a state of the ink circulation system.

FIG. 18 is a diagram showing a state in which standing by for the predetermined amount of time is completed in S1730 and the ink has been pulled out. The ink in the flow path (i.e., the supply flow path C2 and the relief flow path C3) of the sub-tank 151 up to the ejection opening surface 8*a* of the print head 8 has been discharged to the maintenance cartridge CA.

Figure 19:
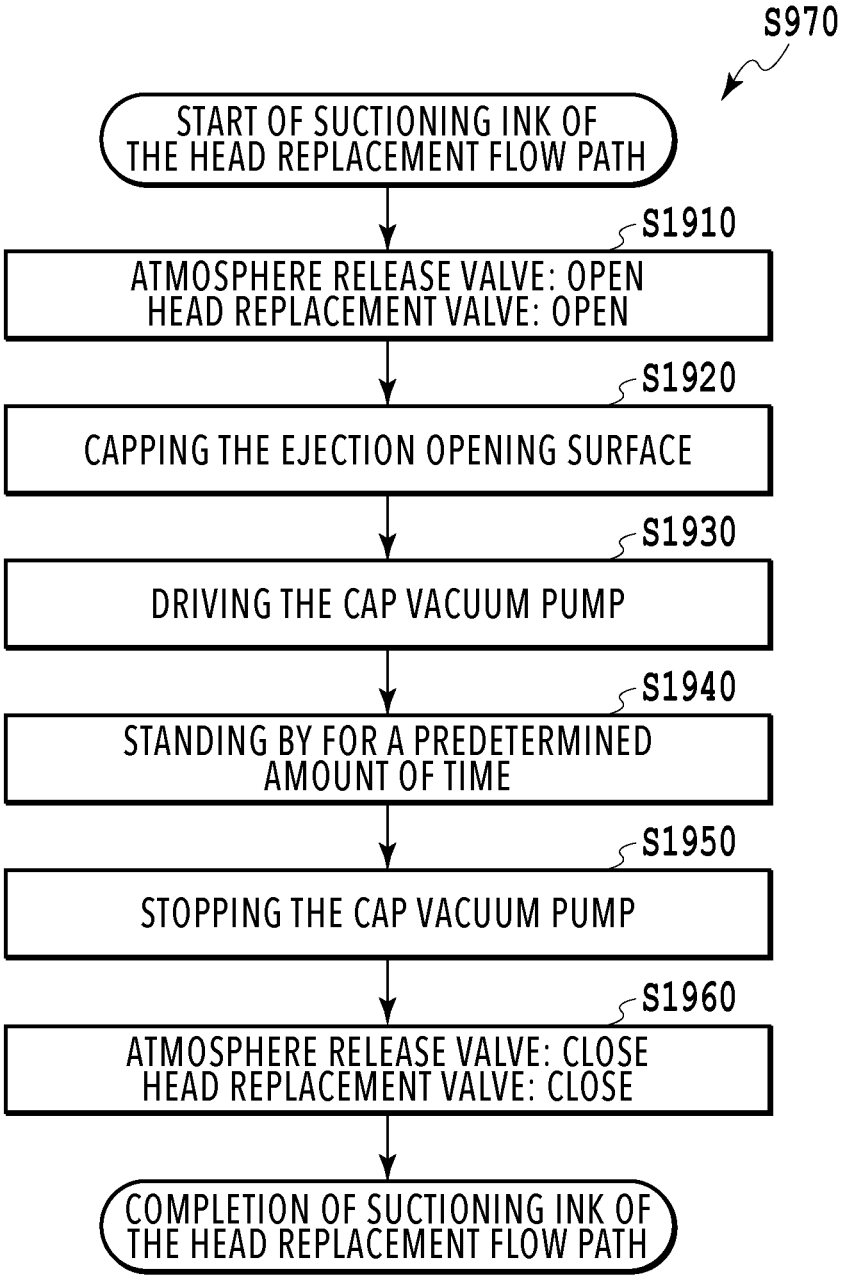
FIG. 19 is a flowchart for explaining the ink suctioning processing for a head replacement flow path.

FIG. 19 is a flowchart for explaining the ink suctioning processing for the head replacement flow path C5 in S970, which is performed after S960. Since the ink of the head replacement flow path C5 remains at this point in time as shown in FIG. 18, the processing of discharging the ink of the head replacement flow path C5 is performed.

In S1910, the ink supply control unit 209 opens the atmosphere release valve V0. Further, the head replacement valve V5 (also referred to as a replacement drive valve) is opened. The atmosphere release valve V0 may not be closed in S1750 and may be kept in an opened state. In this case, the ink supply control unit 209 can simply keep the atmosphere release valve V0 opened in S1910.

In S1920, the ink supply control unit 209 caps the ejection opening surface 8*a* with the cap unit 10. At this point in time, in a case where the ejection opening surface 8*a* has already been capped, the ink supply control unit 209 may simply keep the capping by the cap unit 10 in S1920. In the processing shown in FIG. 9, since the capping is performed in the ink suctioning processing of S960, the ink supply control unit 209 may simply keep the capping by the cap unit 10 in S1920. As described below, S1920 above is a process based on the assumption of a case in which ink in the head replacement flow path C5 is discharged prior to ink in the supply flow path C2.

In S1930, the ink supply control unit 209 drives the vacuum pump P3 (cap vacuum pump). As a result, ink of the head replacement flow path C5 is discharged to the maintenance cartridge CA through the cap unit 10. In S1940, the ink supply control unit 209 stands by for a predetermined amount of time. In S1950, the ink supply control unit 209 stops the vacuum pump P3. In S1960, the ink supply control unit 209 closes the atmosphere release valve V0 and the head replacement valve V5.

Figure 20:
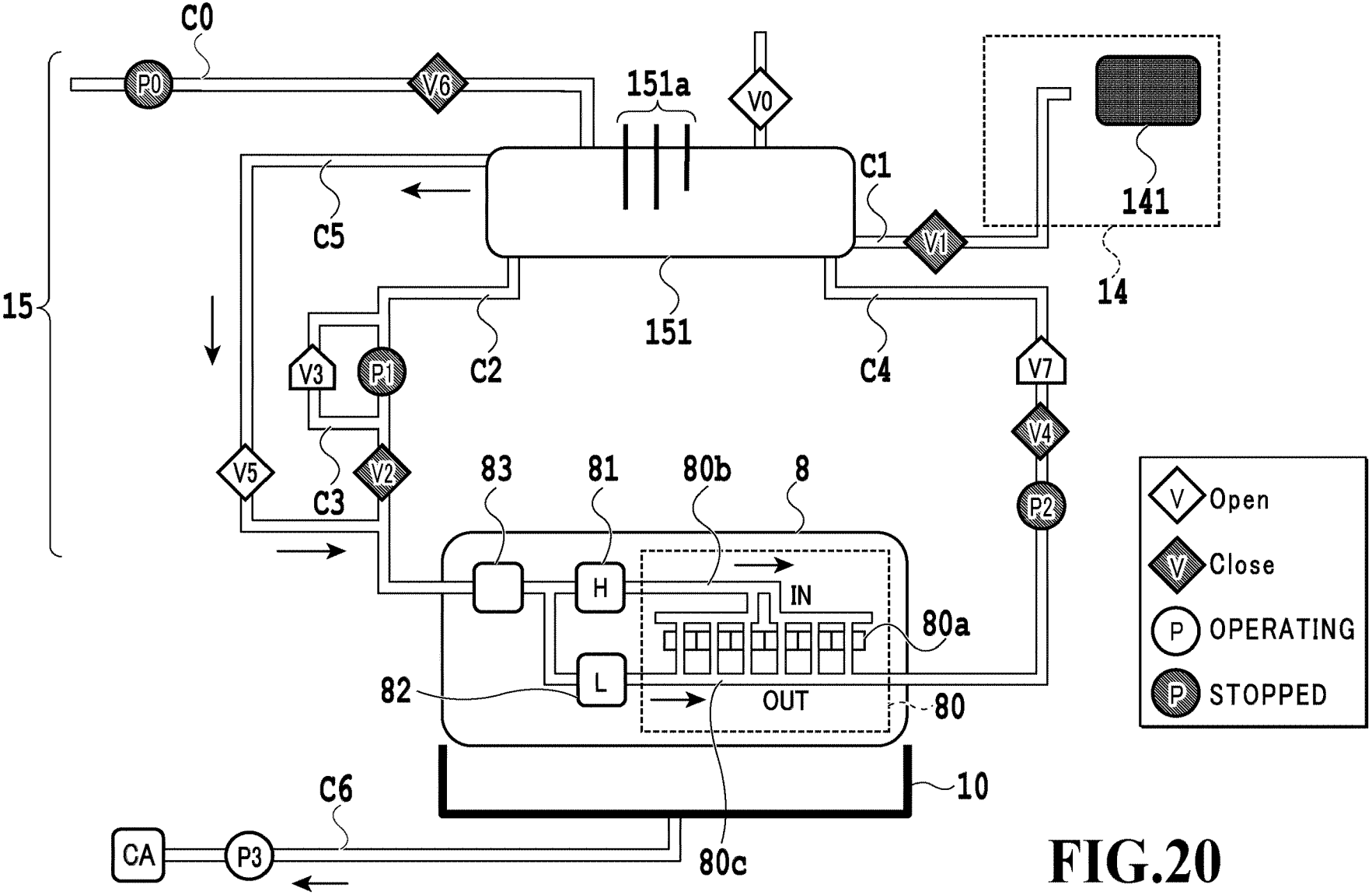
FIG. 20 is a diagram showing a state of the ink circulation system.

FIG. 20 is a diagram showing a state in which ink in the head replacement flow path C5 is discharged in S1940. Through the above processing, the processing in the first transportation mode, that is, the processing of discharging ink is completed.

Modification Example 1

Figure 21:
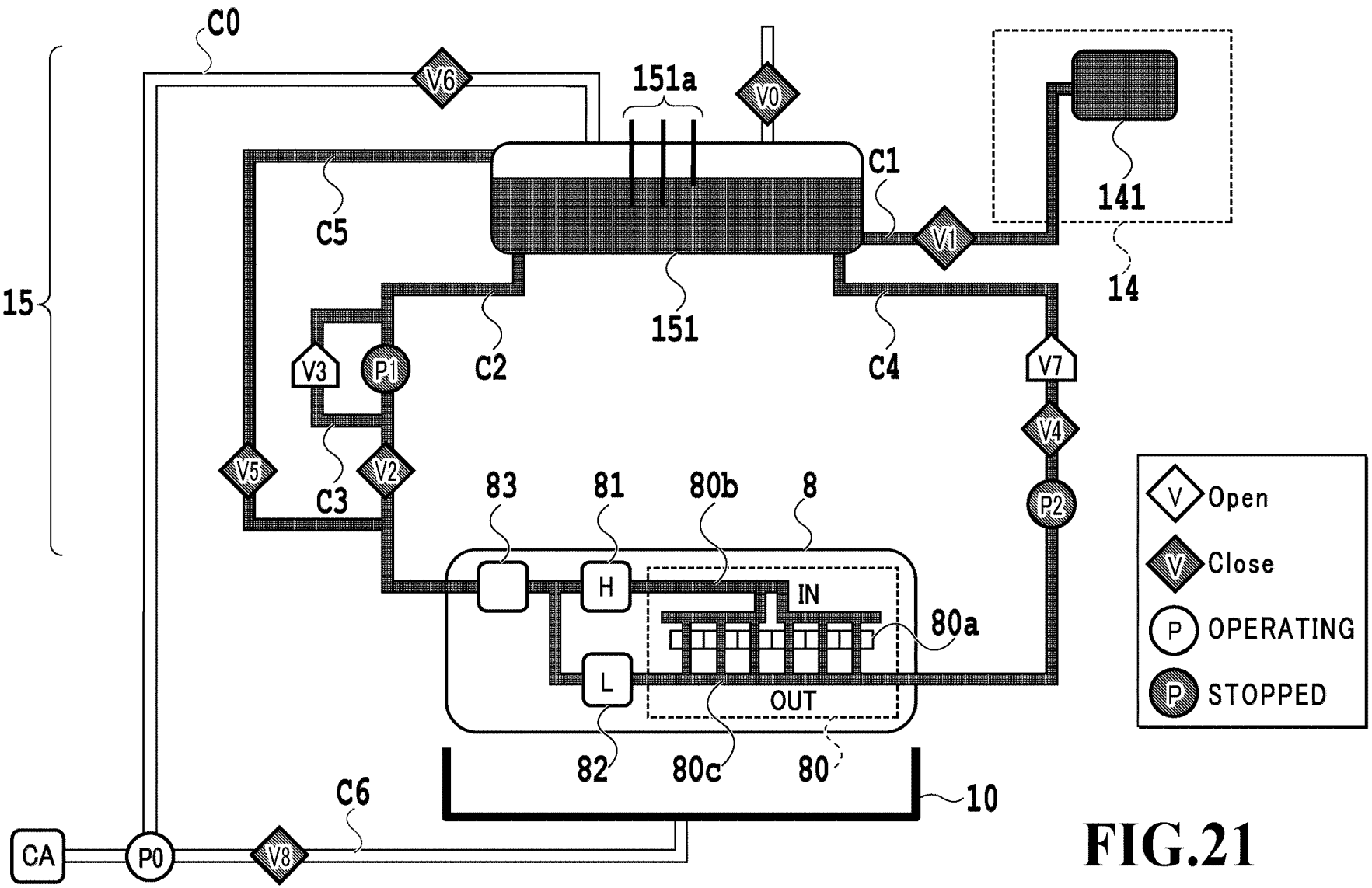
FIG. 21 is a diagram for explaining a flow path configuration of the ink circulation system.

FIG. 21 is a diagram for explaining a modification example. In the above description, an explanation has been given of an example in which the vacuum pump P0 is used to reduce pressure in the sub-tank 151 and the vacuum pump P3 is used to reduce pressure in the cap unit 10. In the modification example, an explanation is given of an example in which the vacuum pump P0 and the vacuum pump P3 are the same pump. As shown in FIG. 21, a common vacuum pump P0 is provided at the connection destinations of the flow path C0 and the flow path C6. In addition, a cap vacuum valve V8 is provided in the flow path C6.

In such a configuration as above, in a case of reducing pressure in the sub-tank 151, the ink supply control unit 209 closes the cap vacuum valve V8 and drives the vacuum pump P0 with the sub-tank vacuum valve V6 being opened. Further, in a case of reducing pressure in the cap unit 10, the ink supply control unit 209 closes the sub-tank vacuum valve V6 and opens the cap vacuum valve V8. Then, the ink supply control unit 209 drives the vacuum pump P0. By appropriately performing such processing in the above-described processing of discharging ink, the same effect can be obtained.

Modification Example 2

The order of the processes in the processing of discharging ink in the first transportation mode is not limited to the one shown in FIG. 9. For example, instead of S960, the processing of discharging ink of the sub-tank 151 up to the head replacement flow path C5 may be performed first. Then, subsequently, the processing of discharging ink remaining in the supply flow path C2 may be performed.

Furthermore, although an explanation has been given of a mode in which the processing of pulling out ink in the flow path of the ejection opening surface 8*a* up to the collection flow path C4 into the sub-tank 151 is performed first and then ink in the sub-tank 151 is discharged to the maintenance cartridge CA, the present embodiment is not limited to this mode. First, ink in the sub-tank 151 may be discharged to the maintenance cartridge CA through an upstream flow path, which may be either one of the supply flow path C2 and the head replacement flow path C5. Then, secondly, ink in the flow path (also referred to as a downstream flow path) of the ejection opening surface 8*a* up to the collection flow path C4 may be pulled out to the sub-tank 151. Further, thirdly, ink in the sub-tank 151 may be discharged to the maintenance cartridge CA through the other upstream flow path, i.e., the other one of the supply flow path C2 and the head replacement flow path C5, which has not been used for discharging ink.

Modification Example 3

Although the configuration in which the head replacement flow path C5 is provided in the configuration of the circulation flow path is taken as an example in the explanation, the present embodiment is not limited to this example. For example, there may be a configuration in which the head replacement flow path C5 and the head replacement valve V5 are not present and only the supply flow path C2 (and the relief flow path C3) are provided. In such a case as above, in the processing of discharging ink in the first transportation mode, the ink suctioning processing for the head replacement flow path C5 in S970 can be omitted.

(Second Transportation Mode)

Next, an explanation is given of the processing of the second transportation mode performed in S705. In the second transportation mode, two major operations are performed. The first operation is an operation in which the vacuum pump P0 (tank vacuum pump) is made to operate with the collection valve V4 being closed, so as to pull out ink in the flow path of the ejection opening surface 8*a* up to the supply flow path C2 or the head replacement flow path C5 into the sub-tank 151. In the first operation, an operation of opening the supply valve V2 or the head replacement valve V5 is performed. Then, ink of the ejection opening surface 8*a* up to the supply flow path C2 or the head replacement flow path C5 is pulled out to the sub-tank 151 through the supply flow path C2 or the head replacement flow path C5. The second operation is an operation in which the vacuum pump P0 (tank vacuum pump) is made to operate with the supply valve V2 and the head replacement valve V5 being closed, so as to pull out ink in the flow path of the ejection opening surface 8*a* up to the collection flow path C4 into the sub-tank 151. That is, in the second transportation mode, processing of pulling out ink in the circulation flow path including the print head 8 through the upstream side of the print head 8 and processing of pulling out the ink through the downstream side of the print head 8 are performed, so as to pull out ink in the print head 8 into the sub-tank 151.

Figure 22:
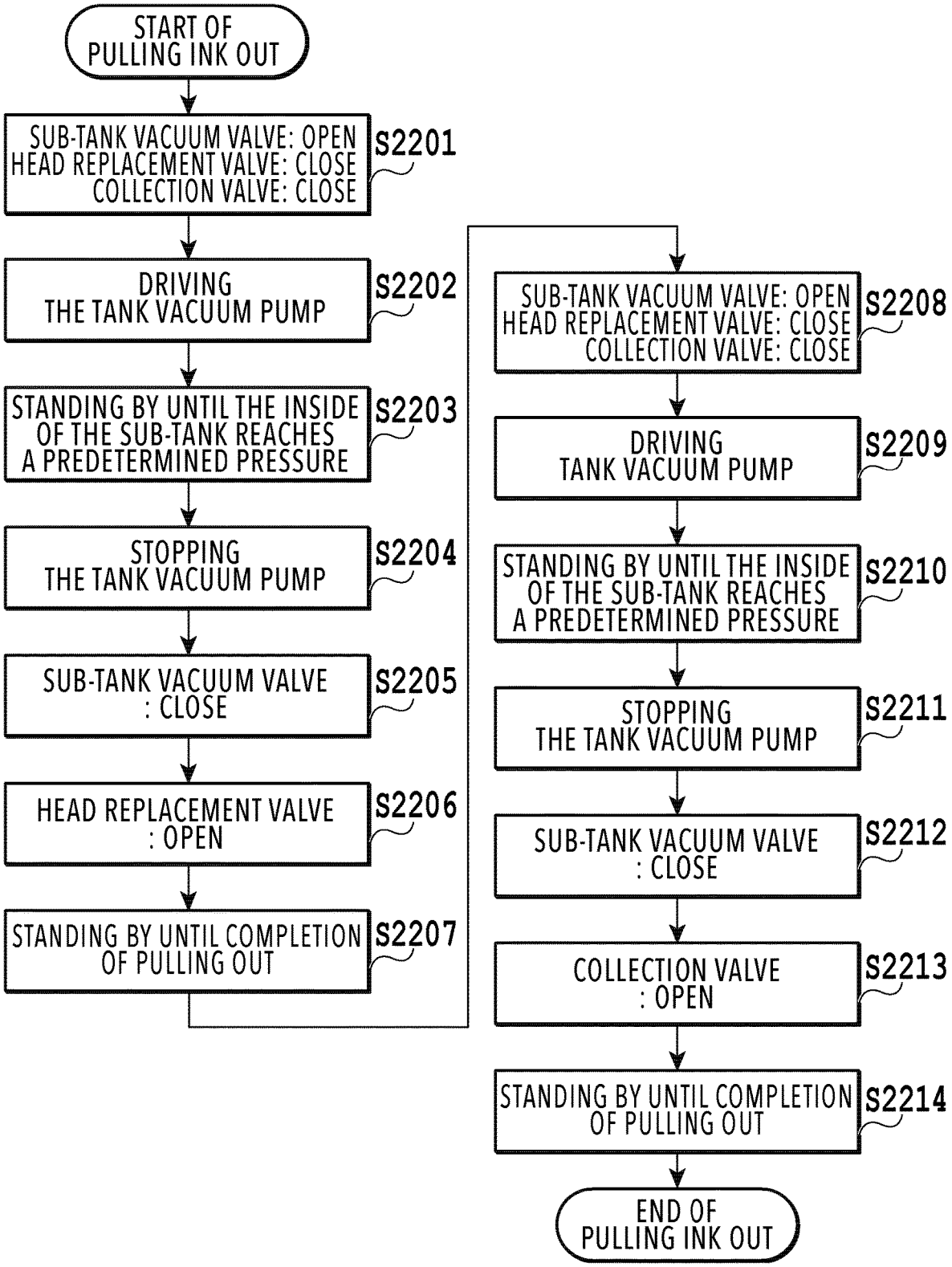
FIG. 22 is a flowchart for explaining processing in a second transportation mode.

FIG. 22 is a flowchart for explaining the processing in the second transportation mode. It is assumed that the state of each valve and each pump before the processing of FIG. 22 is the same as the state shown in FIG. 8. In S2201, the ink supply control unit 209 opens the sub-tank vacuum valve V6. On the other hand, the collection valve V4 and the head replacement valve V5 are kept closed.

Then, in S2202, the ink supply control unit 209 drives the vacuum pump P0 (tank vacuum pump) to generate a negative pressure in the sub-tank 151. The ink supply control unit 209 stands by until the inside of the sub-tank 151 reaches a predetermined negative pressure in S2203 and then stops the vacuum pump P0 in S2204. Accordingly, the closed space formed by the sub-tank vacuum valve V6, the head replacement valve V5, and the collection valve V4 reaches the predetermined negative pressure.

In S2205, the ink supply control unit 209 closes the sub-tank vacuum valve V6 and subsequently opens the head replacement valve V5 in S2206. Accordingly, pulling out of ink on the upstream flow path side is initiated due to the negative pressure charged in the closed space. In S2207, the ink supply control unit 209 stands by for a predetermined amount of time until pulling out of ink is completed.

Figure 23:
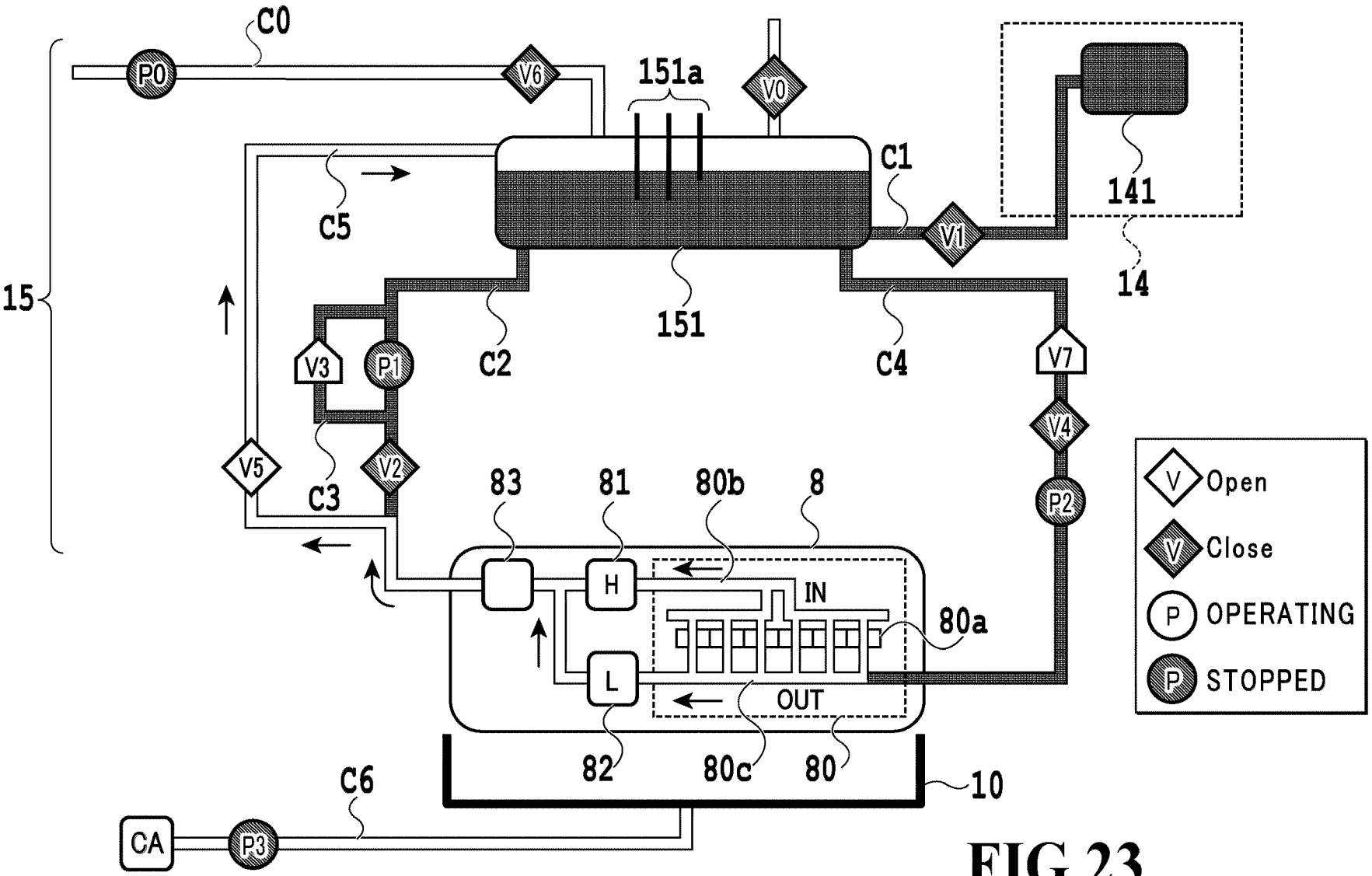
FIG. 23 is a diagram showing a state of the ink circulation system.

FIG. 23 is a diagram showing a state in S2207 where ink has been pulled out. Through the above processing, pulling out of ink from a major part of the print head 8 and a part of the upstream flow path side is completed.

Subsequently, in S2208, the ink supply control unit 209 closes the head replacement valve V5 and the collection valve V4 and opens the sub-tank vacuum valve V6. Then, in the same manner as the upstream flow path side, the ink supply control unit 209 drives the vacuum pump P0 to generate a negative pressure in the sub-tank 151 in S2209. The ink supply control unit 209 stands by until the inside of the sub-tank 151 reaches a predetermined negative pressure in S2210 and then stops the vacuum pump P0 in S2211. Accordingly, the closed space formed by the sub-tank vacuum valve V6, the head replacement valve V5, and the collection valve V4 reaches the predetermined negative pressure.

In S2212, the ink supply control unit 209 closes the sub-tank vacuum valve V6 and subsequently opens the collection valve V4 in S2213. Accordingly, pulling out of ink on the collection flow path C4 side (i.e., the downstream flow path side) is initiated due to the negative pressure charged in the closed space. In S2214, the ink supply control unit 209 stands by for a predetermined amount of time until pulling out of ink is completed.

Figure 24:
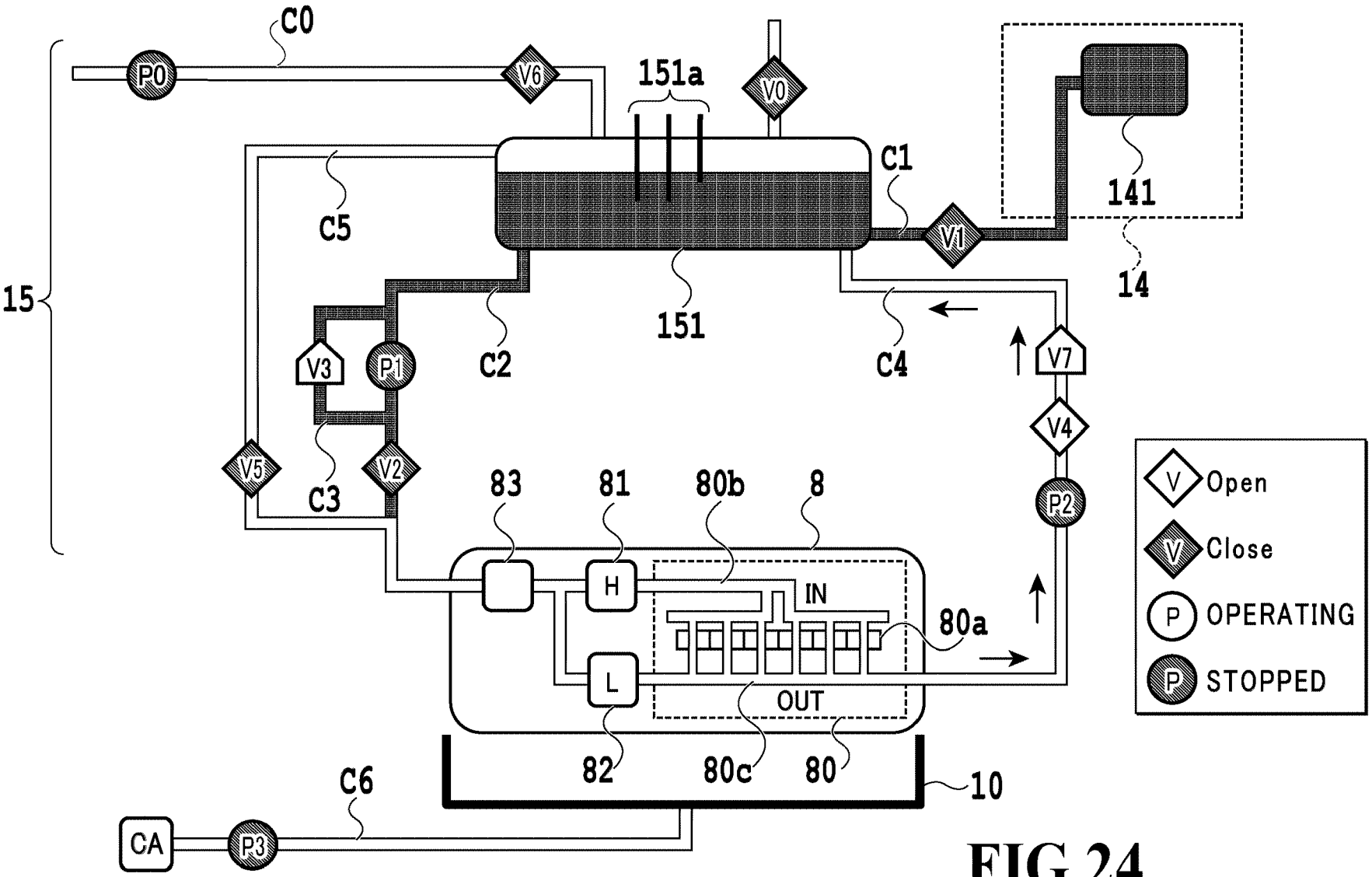
FIG. 24 is a diagram showing a state of the ink circulation system.

FIG. 24 is a diagram showing a state in S2214 where ink has been pulled out. Through the above processing, pulling out of ink from the print head 8 and the collection flow path C4 side is completed, and the flow is terminated.

In the case where the sub-tank vacuum valve V6 is provided and ink in the print head 8, in the upstream flow path, and in the collection flow path C4 is pulled out as described above, the sub-tank vacuum valve V6 is closed after a predetermined negative pressure is charged in the sub-tank 151. There may be a case in which bubbles are formed in the sub-tank 151 due to the atmosphere entered from the ejection opening surface 8*a* and the bubbles reach the upper surface of the sub-tank 151. Even in such a case, by closing the sub-tank vacuum valve V6, it is possible to prevent the bubbles from entering the downstream relative to the sub-tank vacuum valve V6 in the flow path C0.

Modification Example 4

Although a mode in which the upstream flow path from which ink is pulled out in the second transportation mode is the head replacement flow path C5 is taken as an example for the explanation, the present embodiment is not limited to this example. The upstream flow path from which ink is pulled out may be the supply flow path C2. Further, in such a case of a configuration in which the head replacement flow path C5 is not present, the upstream flow path from which ink is pulled out is the supply flow path C2. In this case, the processing in FIG. 22 with the head replacement valve V5 replaced with the supply valve V2 may be performed. Further, as explained in Modification Example 1, the processing may be performed by use of the same vacuum pump.

Other Embodiments

Although, in the embodiment described above, a mode in which the backflow prevention valve V7 is provided on the downstream side relative to the collection valve V4 in the collection flow path C4 is taken as an example for the explanation, the present embodiment is not limited this example. The backflow prevention valve V7 may be provided between the collection valve V4 and the collection pump P2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-189622, filed Oct. 5, 2018, which is hereby incorporated by reference wherein in its entirety.

What is claimed is:

1. An inkjet printing apparatus comprising:

a print head configured to have an ejection opening for ejecting ink;

a first tank configured to contain ink to be supplied to the print head;

a supply flow path configured to connect the first tank to the print head and supply ink to the print head;

a collection flow path configured to connect the print head to the first tank and collect ink from the print head;

a supply valve configured to be capable of opening and closing the supply flow path;

a collection valve configured to be capable of opening and closing the collection flow path;

a tank vacuum pump configured to reduce pressure inside the first tank;

an atmosphere release valve configured to be capable of switching whether or not an inside of the first tank communicates with an atmosphere;

a cap configured to cover the ejection opening;

a cap vacuum pump configured to reduce pressure inside the cap with the ejection opening being covered by the cap; and a control unit configured to perform a first operation for pulling out ink in a flow path of the ejection opening up to the collection flow path into the first tank by operating the tank vacuum pump with the supply valve being closed and a second operation for pulling out ink in a flow path of the first tank up to the ejection opening by operating the cap vacuum pump with the collection valve being closed and the atmosphere release valve being opened.

2. The inkjet printing apparatus according to claim 1, wherein, in the first operation, the control unit is configured to operate the tank vacuum pump with the collection valve being closed so as to reduce pressure inside the first tank into a predetermined negative pressure and then open the collection valve.

3. The inkjet printing apparatus according to claim 1, wherein, in the second operation, the control unit is configured to operate the cap vacuum pump with the supply valve being closed so as to reduce pressure inside the cap into a predetermined negative pressure and then open the supply valve and the atmosphere release valve.

4. The inkjet printing apparatus according to claim 1, further comprising:

a collection pump provided in the collection flow path and configured to circulate ink through the supply flow path, an inside of the print head, and the collection flow path, wherein the control unit is further configured to operate the collection pump in the first operation.

5. The inkjet printing apparatus according to claim 1, further comprising:

a supply pump provided in the supply flow path and configured to circulate ink through the supply flow path, an inside of the print head, and the collection flow path, wherein the control unit is further configured to operate the supply pump in the second operation.

6. The inkjet printing apparatus according to claim 1, wherein the control unit is configured to perform the second operation after the first operation.

7. The inkjet printing apparatus according to claim 1, wherein the first tank is provided above the print head in a direction of gravity.

8. The inkjet printing apparatus according to claim 7, further comprising:

a one-way valve provided in the collection flow path and configured to prevent ink from flowing from the first tank to the print head.

9. The inkjet printing apparatus according to claim 1, wherein the tank vacuum pump and the cap vacuum pump correspond to a same pump.

10. The inkjet printing apparatus according to claim 1, further comprising:

a second tank configured to supply ink to the first tank;

a tank connection flow path configured to supply ink from the second tank to the first tank; and a tank supply valve configured to be capable of opening and closing the tank connection flow path, wherein, after the second tank is removed from the tank connection flow path, the control unit is configured to perform a third operation for pulling out ink in the tank connection flow path into the first tank by operating the tank vacuum pump with the tank supply valve being opened.

11. The inkjet printing apparatus according to claim 1, further comprising:

a replacement flow path configured to connect an upper part of the first tank and the supply flow path; and a replacement valve configured to be capable of opening and closing the replacement flow path, wherein the supply valve is provided in an upstream relative to a connection point of the supply flow path and the replacement flow path in an ink flow direction, and wherein the control unit is configured to perform a fourth operation for pulling out ink in the replacement flow path by operating the cap vacuum pump with the replacement valve and the atmosphere release valve being opened.

12. An inkjet printing apparatus comprising:

a print head configured to have an ejection opening for ejecting ink;

a first tank configured to contain ink to be supplied to the print head;

a supply flow path configured to connect the first tank to the print head and supply ink to the print head;

a collection flow path configured to connect the print head to the first tank and collect ink from the print head; and a circulation unit configured to circulate ink through a circulation flow path including the first tank, the supply flow path, an inside of the print head, and the collection flow path, wherein the inkjet printing apparatus further includes an operating unit configured to allow a user to select a transportation mode from among a plurality of transportation modes.

13. The inkjet printing apparatus according to claim 12, further comprising a display unit configured to display a screen for setting a transportation mode to be used from among the plurality of transportation modes.

14. The inkjet printing apparatus according to claim 12, wherein each of the plurality of transportation modes includes a process of removing ink filled in the print head.

15. The inkjet printing apparatus according to claim 13, wherein, from among the plurality of transportation modes, a first transportation mode is set in a case where the inkjet printing apparatus is to be stored for a long period of time after transportation or in a case where the inkjet printing apparatus is tilted for transportation, and wherein, from among the plurality of transportation modes, a second transportation mode is set in a case where the first transportation mode is not set.

16. The inkjet printing apparatus according to claim 15, further comprising:

a supply valve configured to be capable of opening and closing the supply flow path;

a collection valve configured to be capable of opening and closing the collection flow path;

a tank vacuum pump configured to reduce pressure inside the first tank;

an atmosphere release valve configured to be capable of switching whether or not an inside of the first tank communicates with an atmosphere;

a cap configured to cover the ejection opening;

a cap vacuum pump configured to reduce pressure inside the cap with the ejection opening being covered by the cap; and a control unit configured to perform, in a case where the first transportation mode is set, a first operation for pulling out ink in a flow path of the ejection opening up to the collection flow path into the first tank by operating the tank vacuum pump with the supply valve being closed and a second operation for pulling out ink in a flow path of the first tank up to the ejection opening by operating the cap vacuum pump with the collection valve being closed and the atmosphere release valve being opened.

17. The inkjet printing apparatus according to claim 16, further comprising:

a second tank configured to supply ink to the first tank;

a tank connection flow path configured to supply ink from the second tank to the first tank; and a tank supply valve configured to be capable of opening and closing the tank connection flow path, wherein the display unit is configured to display a message for prompting the user to remove the second tank, and wherein, in a case where completion of removal of the second tank is detected, the control unit is configured to perform a third operation for pulling out ink in the tank connection flow path into the first tank by operating the tank vacuum pump with the tank supply valve being opened.

18. The inkjet printing apparatus according to claim 16, wherein, in a case where the second transportation mode is set, the control unit is configured to perform a fourth operation for pulling out ink in a flow path of the ejection opening up to the supply flow path into the first tank by operating the tank vacuum pump with the collection valve being closed, and a fifth operation for pulling out ink in the flow path of the ejection opening up to the collection flow path into the first tank by operating the tank vacuum pump with the supply valve being closed.

19. A control method of an inkjet printing apparatus including:

a print head configured to have an ejection opening for ejecting ink;

a first tank configured to contain ink to be supplied to the print head;

a supply flow path configured to connect the first tank to the print head and supply ink to the print head;

a collection flow path configured to connect the print head to the first tank and collect ink from the print head;

a supply valve configured to be capable of opening and closing the supply flow path;

a collection valve configured to be capable of opening and closing the collection flow path;

a tank vacuum pump configured to reduce pressure inside the first tank;

an atmosphere release valve configured to be capable of switching whether or not an inside of the first tank communicates with an atmosphere;

a cap configured to cover the ejection opening; and a cap vacuum pump configured to reduce pressure inside the cap with the ejection opening being covered by the cap, the control method comprising:

operating the tank vacuum pump with the supply valve being closed, so as to pull out ink in a flow path of the ejection opening up to the collection flow path into the first tank and operating the cap vacuum pump with the collection valve being closed and the atmosphere release valve being opened, so as to pull out ink in a flow path of the first tank up to the ejection opening.

* * * * *